US011946269B2

(12) United States Patent
Andrews et al.

(10) Patent No.: US 11,946,269 B2
(45) Date of Patent: Apr. 2, 2024

(54) MODULAR INTEGRATED SYSTEM MODULES

(71) Applicant: NAUTILUS TRUE, LLC, San Ramon, CA (US)

(72) Inventors: Gabe Andrews, Colorado Springs, CO (US); Chase Abercrombie Ott, New York, NY (US); Robert C. Pfleging, O'Fallon, MO (US); Patrick J. Quirk, Huntsville, AL (US)

(73) Assignee: Nautilus TRUE, LLC, San Ramon, CA (US)

( * ) Notice: Subject to any disclaimer, the term of this patent is extended or adjusted under 35 U.S.C. 154(b) by 0 days.

(21) Appl. No.: 18/052,867

(22) Filed: Nov. 4, 2022

(65) Prior Publication Data

US 2023/0295940 A1 Sep. 21, 2023

Related U.S. Application Data

(60) Provisional application No. 63/321,991, filed on Mar. 21, 2022.

(51) Int. Cl.

| | |
|---|---|
| ***E04H 1/00*** | (2006.01) |
| ***E04H 1/06*** | (2006.01) |
| ***E04H 1/12*** | (2006.01) |

(52) U.S. Cl.

CPC ..... *E04H 1/005* (2013.01); *E04H 1/06* (2013.01); *E04H 2001/1283* (2013.01)

(58) Field of Classification Search

CPC ..... E04H 2005/005; E04H 1/005; E04H 2001/1283; H05K 7/1497

See application file for complete search history.

(56) References Cited

U.S. PATENT DOCUMENTS

| | | | |
|---|---|---|---|
| 8,988,879 | B2 | 3/2015 | Hamburgen et al. |
| 9,439,322 | B1 | 9/2016 | Magcale et al. |
| 9,784,460 | B2 | 10/2017 | Magcale et al. |
| 9,814,163 | B2 | 11/2017 | Magcale et al. |
| 10,111,361 | B2 | 10/2018 | Magcale et al. |
| 10,178,810 | B1 | 1/2019 | Magcale et al. |
| 10,437,636 | B2 | 10/2019 | Magcale et al. |
| 10,470,342 | B2 | 11/2019 | Magcale et al. |
| 10,673,684 | B2 | 6/2020 | Magcale |

(Continued)

FOREIGN PATENT DOCUMENTS

| | | |
|---|---|---|
| WO | WO-2013070104 A1 | 5/2013 |
| WO | WO-2023183264 | 9/2023 |

OTHER PUBLICATIONS

Co-pending U.S. Appl. No. 16/902,430, inventor Magcale; Arnold, filed Jun. 16, 2020.

(Continued)

*Primary Examiner* — Gisele D Ford

(74) *Attorney, Agent, or Firm* — Wilson Sonsini Goodrich & Rosati

(57) ABSTRACT

The present disclosure provides for a modular design and build architecture, comprising: one or more integrated system module (ISMs) that are configured to be shipped and assembled on-site to construct an operational infrastructure for one or more application environments, wherein each of the ISMs comprises two or more different functional components that are integrated onto and/or supported by a common structural floor.

24 Claims, 22 Drawing Sheets

(56) References Cited

U.S. PATENT DOCUMENTS 10,852,805 B2 12/2020 Magcale et al.
11,102,915 B1 8/2021 Magcale
11,182,201 B1 11/2021 Magcale
11,224,145 B2 1/2022 Magcale et al.
11,246,243 B2 2/2022 Magcale et al.
11,297,742 B2 4/2022 Magcale et al.
2009/0050591 A1* 2/2009 Hart ..... G06F 1/206 211/183
2010/0110626 A1* 5/2010 Schmitt ..... H05K 7/20745 361/679.49
2010/0114356 A1* 5/2010 Schmitt ..... G06F 1/20 700/117
2010/0170277 A1* 7/2010 Schmitt ..... H05K 7/20745 165/104.34
2011/0083824 A1* 4/2011 Rogers ..... H05K 7/20181 312/236
2011/0138708 A1* 6/2011 Chazelle ..... E04H 1/06 52/302.1
2012/0134107 A1* 5/2012 Peng ..... H05K 7/2079 361/679.53
2012/0152777 A1* 6/2012 Lin ..... H05K 7/1497 206/320
2012/0255710 A1* 10/2012 Maselli ..... E04H 5/02 165/80.2
2014/0157692 A1* 6/2014 Parizeau ..... E04H 5/00 52/173.1
2014/0213169 A1 7/2014 Rasmussen et al.
2014/0331582 A1* 11/2014 Klaba ..... H05K 7/20745 52/234
2015/0098177 A1* 4/2015 Wilcox ..... E04H 5/02 29/592
2015/0240474 A1* 8/2015 Kokoschka ..... E04B 1/34384 52/745.02
2015/0305203 A1* 10/2015 Chang ..... H05K 7/20745 361/679.48
2016/0057894 A1* 2/2016 Chen ..... H05K 7/20745 361/679.46
2016/0194863 A1* 7/2016 Schmitt ..... E04H 1/00 52/745.02
2016/0249484 A1* 8/2016 Parizeau ..... H05K 7/20745
2018/0109163 A1* 4/2018 Paine ..... E04H 5/04
2019/0343025 A1 11/2019 Magcale et al.
2020/0348034 A1 11/2020 Magcale
2021/0081022 A1 3/2021 Magcale
2022/0075648 A1 3/2022 Magcale
2022/0106784 A1* 4/2022 Igarashi ..... E04H 5/02
2022/0145611 A1* 5/2022 Kuehmstedt ..... E04H 1/12
2022/0188634 A1 6/2022 Magcale
2023/0078304 A1 3/2023 Liu et al.

OTHER PUBLICATIONS

Co-pending U.S. Appl. No. 17/381,182, inventor Magcale; Arnold, filed Jul. 20, 2021.
Co-pending U.S. Appl. No. 17/460,672, inventor Magcale; Arnold, filed Aug. 30, 2021.
Co-pending U.S. Appl. No. 17/531,707, inventor Magcale; Arnold, filed Nov. 19, 2021.
Co-pending U.S. Appl. No. 17/588,363, inventors Magcale; Arnold et al., filed Jan. 31, 2022.
U.S. Appl. No. 17/531,707 Office Action dated Mar. 23, 2023.
PCT/US2023/015698 International Search Report and Written Opinion dated Apr. 17, 2023.
U.S. Appl. No. 17/531,707 Office Action dated Oct. 26, 2023.

* cited by examiner

MODULAR INTEGRATED SYSTEM MODULES

CROSS-REFERENCE

This application claims the benefit of U.S. Provisional Application No. 63/321,991, filed Mar. 21, 2022, which is hereby incorporated by reference in its entirety herein.

BACKGROUND

The industrialization of the construction of facilities such as data centers, manufacturing facilities, laboratories, and medical facilities has enabled the industry to dramatically reduce build times and costs.

SUMMARY

The industrialization of the construction of facilities such as data centers, manufacturing facilities, laboratories, and medical facilities has enabled the industry to dramatically reduce build times and costs. However, there still exists a need for further refining the construction process to further reduce costs and the time required for constructing such facilities. As an example, the disclosure herein discusses ways in which the amount of material, time, costs, number of shipments or shipping splits, and on-site construction can be reduced when constructing such facilities. Further, the disclosure discusses ways to modularize the infrastructure of such facilities so as to reduce costs and time for maintenance, conversion and/or upgrading of such facilities.

Provided in some embodiments herein is a modular design and build architecture, comprising: one or more integrated system module (ISMs) that are configured to be shipped and assembled to construct an operational infrastructure for one or more application environments, wherein each of the ISMs comprises two or more different functional components that are integrated onto and/or supported by a common structural floor.

In some embodiments, the one or more application environments comprises: (i) a data center; (ii) a location with information storage, processing or communication capabilities or functionalities; or (iii) a facility requiring one or more operational infrastructural elements.

In some embodiments, the one or more ISMs are assembled to form one or more levels within the one or more application environments. In some embodiments, the one or more levels are configured to increase vertical density and reduce one or more of an area, volume, or space footprint of the one or more application environments. In some embodiments, individual ISMs on the one or more levels are removable or replaceable.

In some embodiments, the one or more levels are configured to separate or divide a volume or space within the one or more application environments. In some embodiments, the one or more levels comprises a porous layer that is permeable to air, gas or a fluid.

In some embodiments, the one or more levels comprises a barrier layer that is impermeable to air, gas or a fluid. In some embodiments, the one or more levels comprises at least one level that comprises or forms an interstitial space.

In some embodiments, the two or more different functional components are associated with at least one or more of the following: electrical, power, mechanical, plumbing, cooling, heating, network connectivity, data transmission, sensors or sensing, fire suppression, and/or chemical or biological material management.

In some embodiments, the one or more ISMs are provided having a standardized size or format to facilitate ease of transport such that the ISMs are capable of being shipped using conventional transportation modes and fewer number of shipping splits, and without requiring size, weight or height modifications or customization of transportation containers or vehicles, wherein the conventional transportation modes comprise land, sea, rail or air transportation modes.

In some embodiments, the one or more ISMs utilize a platform base that enables (i) interchangeability of functional components or their physical order/arrangement within an ISM, and/or (ii) interchangeability, coupling or changes in arrangement order between different ISMs.

In some embodiments, the one or more ISMs are configured to facilitate rapid assembly using fewer number of mechanical and/or electrical connections/connectors and less time, compared to other application environments that are not constructed using said ISMs.

Provided in some embodiments herein is a method of modularly constructing an operational infrastructure, the method comprising: (a) providing one or more integrated system modules (ISMs), wherein each of the ISMs comprises two or more different functional components that are integrated onto and/or supported by a common structural floor, and (b) assembling the one or more ISMs to construct the operational infrastructure for one or more application environments.

BRIEF DESCRIPTION OF THE DRAWINGS

The novel features of the present disclosure are set forth with particularity in the appended claims. A better understanding of the features and advantages of the present disclosure will be obtained by reference to the following detailed description that sets forth illustrative embodiments, in which various principles are utilized and described, and the accompanying drawings of which:

DETAILED DESCRIPTION

Figure 1:
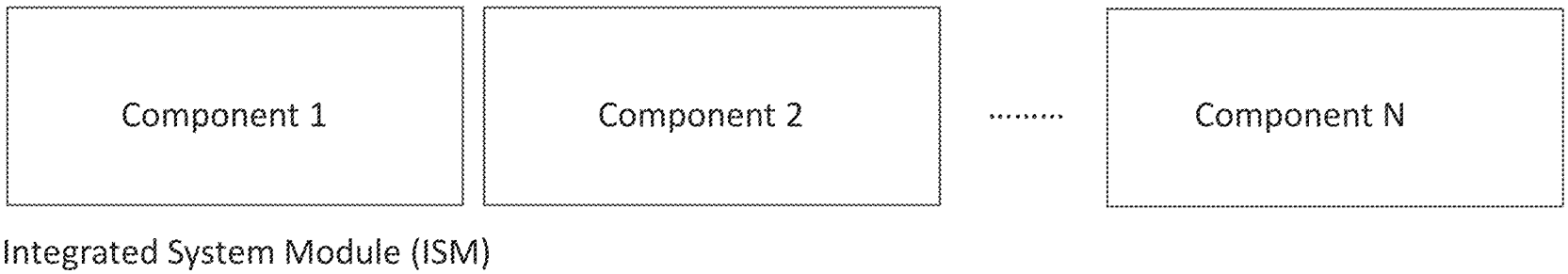
FIG. 1 is a block diagram for an Integrated System Module (ISM), as described herein, in accordance with some embodiments.

Reference will now be made in detail to exemplary embodiments of the disclosure, examples of which are illustrated in the accompanying drawings. Wherever possible, the same reference numbers will be used throughout the drawings and disclosure to refer to the same or like parts.

As used in the specification and claims, the singular form "a", "an" and "the" include plural references unless the context clearly dictates otherwise.

As used herein, the term "about" a number refers to that number plus or minus 10%, 9%, 8%, 7%, 6%, 5%, 4%, 3%, 2%, 1%, of that number.

As used herein, and unless otherwise specified, the term "substantially" and similar terms are defined as largely but not necessarily wholly what is specified, as understood by a person of ordinary skill in the art. In any disclosed embodiment, the terms "substantially," "approximately," "generally," and "about" may be substituted with "within [a percentage] of" what is specified, where the percentage includes 0.1, 1, 5, and 10 percent.

The terms facility, building, structure may be used interchangeably herein.

The term component may be referred to interchangeably as a system or subsystem. In some instances, a component may be a system or a subsystem. In other cases, a component may be part of a system or a subsystem.

The term Integrated System Modules (ISM) may also be referred to as a skid interchangeably herein.

The term one or more ISMs may refer to one ISM, multiple ISMs, a sub-assembly of ISMs, or an assembly of ISMs.

The term modular assembly kit and kit may be referred to interchangeably herein.

Disclosed herein are modular Integrated System Modules (ISMs) for use in a variety of application environments. The dimensions, weight, and inclusion of different functional components of the ISMs may be configured in such a way that the ISMs can be modularly applied to one or more application environments. The dimensions, weight, and inclusion of different functional components of the ISMs may be configured in such a way that the ISMs can be shipped using a variety of shipping methods. The dimensions, weight, and inclusion of different functional components of the ISMs may be configured in such a way that different functional components can be removed or added to an assembly or subassembly of ISMs as to upgrade and/or adapt the ISM(s) to different application environments. The ISMs may be configured to be shipped and assembled on-site to construct an operational infrastructure for the one or more application environments. In some embodiments, the one or more integrated system module (ISMs) that are configured to be shipped and assembled to construct an operational infrastructure for one or more application environments, wherein each of the ISMs comprises two or more different functional components that are integrated onto and/or supported by a common structural floor. In some instances, some of the ISMs can be assembled off-site to construct a sub-assembly of ISMs, that are shipped and later integrated on-site with the existing ISMs that are already in the application environment. In some instances, a single/individual ISM can be shipped and installed in one or more application environments. In some instances, one or more individual ISMs are shipped and installed in one or more application environments. In some instances, a group or collection of ISMs (e.g., that are yet to be assembled) are shipped and installed in one or more application environments. In some embodiments, an assembly or sub-assembly of ISMs In some embodiments, a modular design and build architecture may comprise one or more ISMs that are configured to be shipped and assembled on-site to construct an operational infrastructure for one or more application environments, wherein each of the ISMs may comprise two or more different functional components that are integrated onto and/or supported by a common structural floor.

In some embodiments, the one or more application environments may comprise a data center. In some embodiments, the data center may comprise a land-based data center or a water-based data center. In some embodiments, the one or more application environments may comprise a manufacturing facility, a laboratory, or a medical facility, or the like. In some embodiments, the one or more application environments may comprise a cryptocurrency mining facility, or a vertical farming facility, or the like. In some embodiments, the one or more application environments comprise a data center, a location with information storage, processing or communication capabilities or functionalities, or a facility requiring one or more operational infrastructural elements.

FIG. 1 illustrates a block diagram of an example ISM as described herein. As shown in FIG. 1, the ISM may include one or more functional components. As an example, the ISM may include two or more different functional components that are integrated onto and/or supported by a common structural floor.

The two or more functional components in any embodiment described herein may be associated with, as a non-limiting example, at least one or more of the following: electrical, mechanical, plumbing, cooling, network connectivity, and/or fire suppression. In some embodiments, wherein the two or more different functional components are associated with at least one or more of the following: electrical, power, mechanical, plumbing, cooling, heating, network connectivity, data transmission, sensors or sensing, fire suppression, and/or chemical or biological material management. In some embodiments, the two or more functional components in any embodiment described herein may be associated with, as a non-limiting example, at least one or more of the following: gantry systems for moving equipment, a Heating, Ventilation, and Air Conditioning (HVAC) system, a vacuum system, an air purifier system, or any other equipment involved in the manufacturing of a product (e.g., semiconductor manufacturing, drug manufacturing, food manufacturing, automobile manufacturing, etc.). Each of these different types of functional components will be described in further detail herein. In some embodiments, the two or more different functional components may comprise at least one functional component that is located beneath the structural floor. In some embodiments, the at least one functional component beneath the structural floor may comprise a first functional component comprising of a Mechanical, Electrical and Plumbing (MEP) package that can be located in an interstitial space beneath a top surface of the structural floor. In some embodiments, the at least one functional component beneath the structural floor may comprise a second functional component comprising of one or more ceiling packages below and/or in proximity to the MEP package In some embodiments, the ceiling package can be located above or overhead of the one or more application environments. In some embodiments, the ceiling package can be configured to vertically connect to the one or more application environments. In some embodiments, the two or more different functional components may comprise a first functional component and a second functional component, wherein the first functional component can be configured to be supported on a top surface of the structural floor, and the second functional component can be configured to be supported in an interstitial space beneath the top surface of the structural floor.

In some embodiments, the first functional component may comprise electrical power equipment or a cooling distribution unit (CDU). In some embodiments, the second functional component may comprise a mechanical, electrical, and plumbing (MEP) package. In some embodiments, the two or more different functional components further comprise a third functional component adjacent to the interstitial space. In some embodiments, the third functional component may comprise a ceiling package that is configured to be connected to the one or more application environments in an overhead manner. In some embodiments, the third functional component is located closer to the one or more application environments than the first functional component or the second functional component. In some embodiments, the third functional component is located closer to the second functional component than the first functional component. In some embodiments, the second functional component is located between the first functional component and the third functional component. In some embodiments, at least one of the first, second, or third functional components are functionally and/or operationally decoupled from the other functional components. In some embodiments, all of the first, second, and third functional components are functionally and/or operationally decoupled from each other.

Figure 2A:
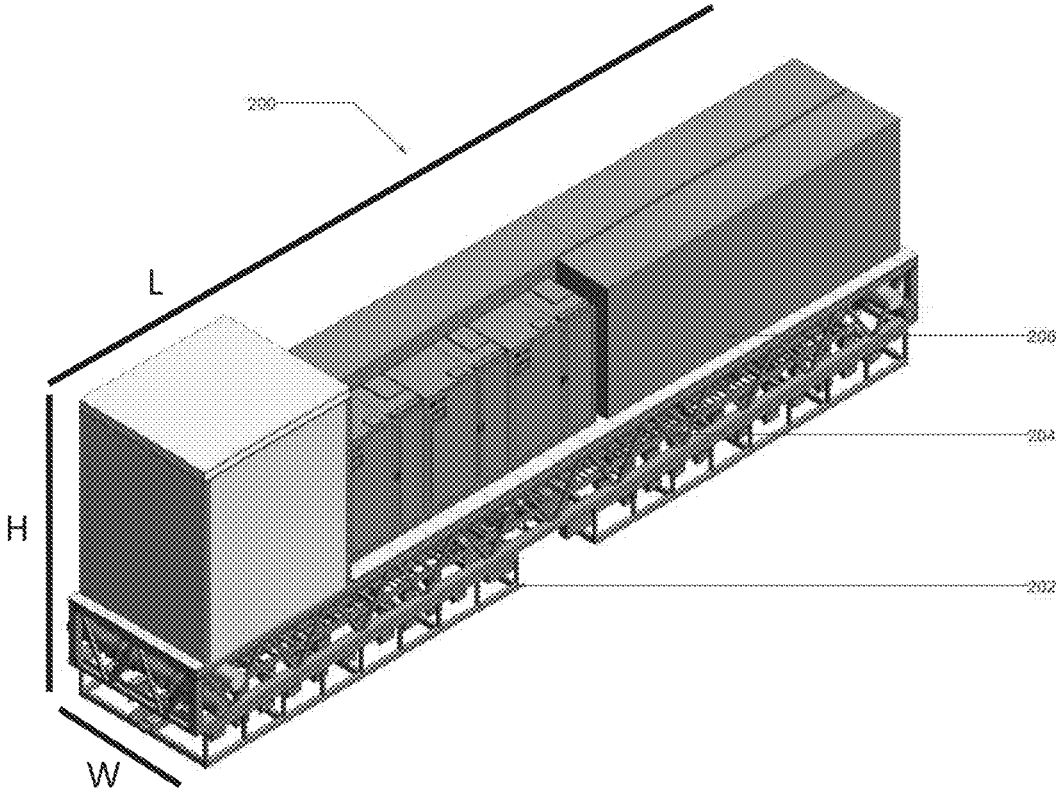
FIG. 2A is a perspective view of an ISM, in accordance with some embodiments.

FIG. 2A illustrates a perspective view of an example ISM 200 comprising three functional components. As shown in FIG. 2A, the functional components may comprise a ceiling package 202, a structural floor 204, and electrical power equipment 206. As an example, the ISM of FIG. 2A may be applicable for a data center. The ISM may also be applicable to one or more other application environments as described herein.

The ceiling package 202 of the ISM can be located below and in close proximity to the structural floor 204, such that it is the closest functional component to an application environment below the ISM. As an example, the ceiling package 202 may be located above or overhead of a data center. The ceiling package 202 may comprise the necessary connections to connect to the data center. As an example, the ceiling package may include the necessary power and network connectivity cabling required by the data center to be powered at all times and to connect to a network. Additionally, the ceiling package 202 may include the necessary power cables for use in providing power to different components of the data hall (e.g., lights, alarms, ventilation, and other equipment commonly used in a data hall environment). In some embodiments, the ceiling package allows the one or more ISMs to be connected to the servers, storage devices, and/or networking gear that are in the data hall. As an additional example, the application environment may be a manufacturing facility, and the ceiling package may house the power cables, compressed air lines, hydraulic lines, etc. necessary for running the manufacturing equipment below the ISM.

In some embodiments, a MEP package may be included and located beneath the structural floor 204. As shown in FIG. 2A, the MEP package and the ceiling package 202 are located beneath the structural floor. The electrical power equipment 206 is located above the structural floor 204. In some embodiments, the MEP package may comprise the equipment necessary for properly running and maintaining the facility housing the application environment (e.g., data center, or manufacturing facility) and/or the equipment necessary for properly running and maintaining the application environment (e.g., data center, or manufacturing facility). As an example, the application environment may comprise a data center comprising a data hall comprising a plurality of data racks. The MEP package may comprise the necessary mechanical, electrical, and plumbing equipment necessary for a building housing the data hall. In some embodiments, the facility may house two or more application environments. The MEP package of the one or more ISMs may then be configured to such a facility comprising the two or more application environments.

In some embodiments, the MEP package may also comprise the equipment necessary for properly running and maintaining the application environment. As an example, the application environment may be a data center and the MEP package may include the necessary cooling pipes for use in cooling and keeping the data hall at a desired temperature.

As shown in FIG. 2A, the MEP package may be located beneath the structural floor 204. In some embodiments, the MEP package is located in an interstitial space beneath a top surface of the structural floor. As shown in FIG. 2A, the interstitial space beneath the top surface of the structural floor may be partially enclosed. In some embodiments, the interstitial space beneath the top surface of the structural floor is partially enclosed by stanchions, bulkhead, walls, gantries, and/or trusses. In some embodiments, the stanchions, bulkhead, walls, gantries, and/or trusses provide structural integrity to the structural floor. In some embodiments, the stanchions, bulkhead, walls, gantries, and/or trusses are designed to protect the second functional component that is located in the interstitial space. As shown in FIG. 2A, the interstitial space beneath the structural floor 204 is configured to enclose the MEP package.

As shown in FIG. 2A, the ceiling package 202 is below and in close proximity to the MEP package. In some embodiments, the ceiling package 202 may be configured to comprise the necessary mechanical connections/connectors to connect the ceiling package 202 to the MEP package. In some embodiments, the ceiling package 202 is not connected to the MEP package.

Figure 2B:
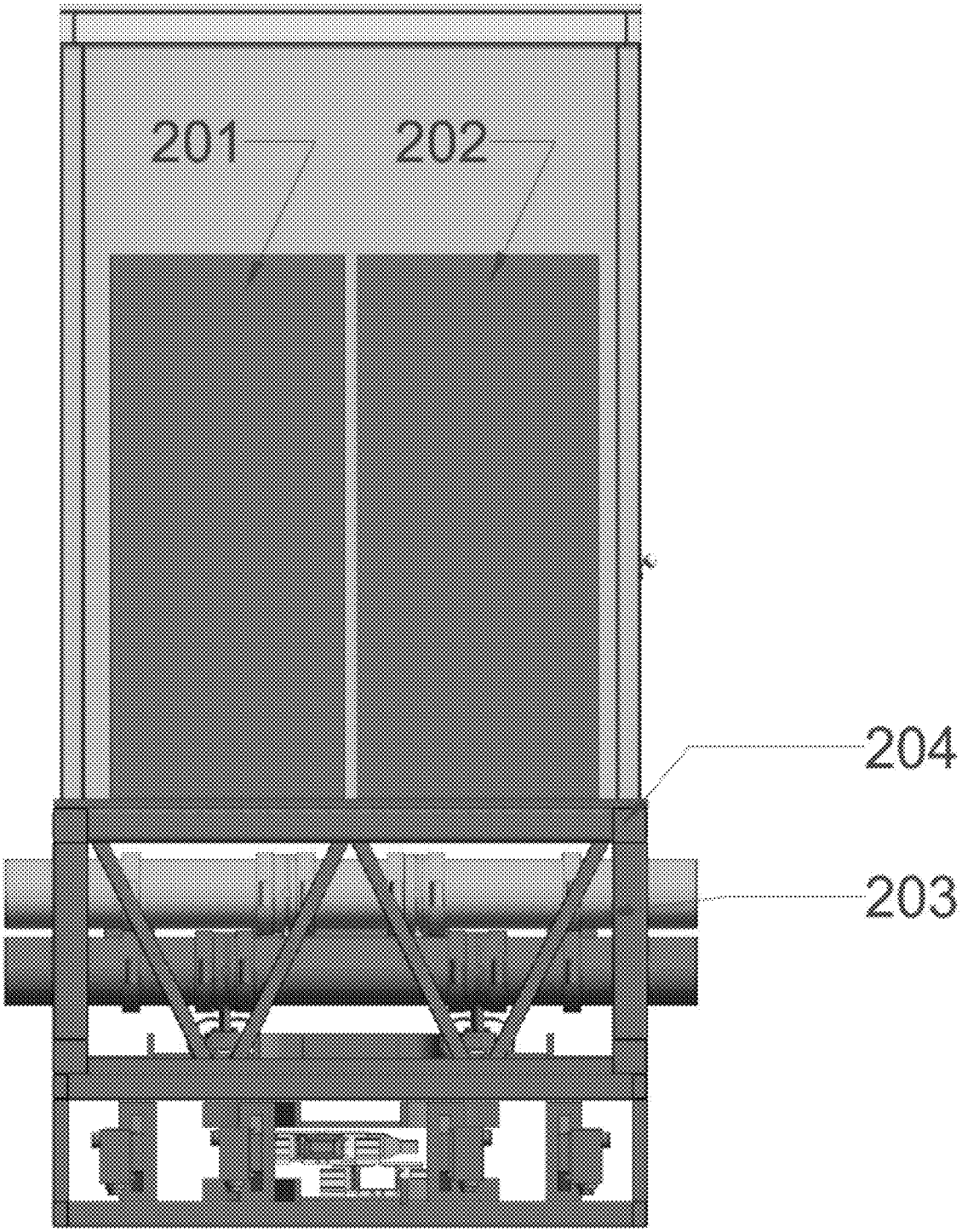
FIG. 2B is a cross-sectional view of an ISM, in accordance with some embodiments.

FIG. 2B illustrates a cross-sectional view of an ISM 200. As shown in FIG. 2B, the electrical power equipment 201 and 202 are mounted on top of the structural floor 204. The structural floor, in this example, includes an interstitial space 203 comprising a steel truss for structural integrity and for providing space wherein the different functional components of the ISM can be housed and protected. In some embodiments, the interstitial space 203 may enclose a MEP package. In some embodiments, the interstitial space 203 may enclose both a MEP package and a ceiling package. In some embodiments, the interstitial space 203 may enclose a MEP package, and the ISM may comprise a ceiling package below the interstitial space 203. In some embodiments, the interstitial space may enclose a MEP package and a portion of a ceiling package.

In some embodiments, the one or more ISMs are provided having a standardized size or format to facilitate ease of transport such that the ISMs are capable of being shipped using conventional transportation modes and fewer number of shipping splits, and without requiring size, weight or height modifications or customization of transportation containers or vehicles, wherein the conventional transportation modes comprise land, sea, rail or air transportation modes.

In some embodiments, the one or more ISMs utilize a platform base that enables (i) interchangeability of functional components or their physical order/arrangement within an ISM, and/or (ii) interchangeability, coupling or changes in arrangement order between different ISMs. In some embodiments, the platform base from one ISM to another may differ in structure or size (e.g., steel size), but the way in which each of the many functional components the ISM may accommodate is coupled to the platform base may remain the same from one ISM to another. As will be described herein, each individual functional component of the ISM can be accessed, repaired, replaced, and/or upgraded with new or different functional components. This greatly increased the flexibility of the ISMs and the ease with which the ISMs can be adjusted or modified to accommodate to the one or more application environments. This allows an existing ISM assembly to be modified to accommodate to an entirely new application environment than it was previously designed for, without the need for an entirely new assembly of ISMs of need for a new building housing the new application environment. In some embodiments, the standardized size/format allows for more production/fabrication during the manufacturing process at the factory and leaves less on-site work to be done once the ISMs are delivered to their intended application environment, as compared to standard designs. In some embodiments, the one or more ISMs are configured to facilitate rapid assembly using fewer number of mechanical and/or electrical connections/connectors and less time, compared to other data centers that are not constructed using the ISMs. Reducing the number of mechanical and electrical connections allows for rapidly reduced on-site time to install the ISM system, thus requiring less labor, time, and money to install the ISM system.

In some embodiments, the conventional transportation modes that may be used to transport the ISMs include land, sea, rail, and air transportation mode. In some embodiments, in addition to requiring less on-site installation, the standardization of the ISMs also allows for fewer shipping splits. As an example, a current state of the art system may require anywhere upwards of 40 individual shipments to ship all the required equipment for installing the system. In some embodiments, the ISMs described herein allow for more equipment to be included in each ISM, thus reducing the total number of shipments required. For example, the ISMs of the present invention can reduce the total number of required shipments by 50% or more. In some preferred embodiments, the ISMs of the present invention can reduce the total number of required shipments by about 60% to about 90%.

In some embodiments, the standardized ISMs also require less materials in the manufacturing/production process as compared to current state of the art systems. For example, materials may comprise the concrete, steal, wiring, etc., to produce the one or more ISMs. In some embodiments, the standardized ISMs may reduce material usage by at least 30% or more as compared to current state of the art systems.

Looking back to FIG. 2A, the ISMs 200 may comprise a height (H), length (L), and width (W) dimension. In some embodiments, the dimensions of the ISMs may be constrained by standard shipping requirements such as bridge heights, roadway widths, and vehicle lengths. In some embodiments, the dimensions of the ISMs may be constrained to within the standardized dimensions of shipping containers.

In some embodiments, a height of the ISM is configured in such a way to accommodate a mode of shipping. For example, a height of each ISM may be based on a bridge height on a shipping road or the height of a shipping container housing the ISM for shipping. In some embodiments, a height of each ISM may change from ISM to ISM. In some embodiments, a height of each ISM is determined by the two or more functional equipment included in each ISM. In some embodiments, a height of each ISM may change as the functional components of the ISM are changed.

In some embodiments, a length of each ISM is configured in such a way to accommodate a mode of shipping. For example, the length may be based on a maximum length of an open bed trailer, or a maximum length of a shipping container housing the ISM for shipping.

In some embodiments, a width of each ISM is configured in such a way to accommodate a mode of shipping. For example, a width of each ISM may be based on the width of highway and/or interstate lanes in the country in which the ISM is being shipped. In some embodiments, the country is the United States. In some embodiments, the country is a European country. In some embodiments, the country is any country.

In some embodiments, a length and a width of each ISM constitutes a footprint size of the ISM. In some embodiments, a footprint size of each ISM is configured to accommodate a mode of shipping or to accommodate to a specific facility housing an application environment. A footprint size may be configured to allow for a maximum number of ISMs to be installed into an application environment.

In some embodiments, the modularity, especially the way in which the vertical height of the ISMs can be extended and adjusted, of the ISMs allows for a greatly reduced footprint as compared to current state of the art systems. In some embodiments, the ISMs of the present disclosure allow for about 40% or greater reduction in footprint as compared to current systems. In some preferred embodiments, the ISMs of the present disclosure allow for about a 40% to about a 60% reduction in footprint as compared to current systems. As an example, a current system for a 10 MW data center may require 36000 square feet or more of building space to successfully run and maintain the data center. A data center implementing the one or more ISMs of the present disclosure may reduce that footprint to 18000 square feet. This is because the ISMs include the two or more functional components that are stacked vertically. Current systems require individual pieces of equipment for cooling, electrical power supply, plumbing, mechanical, wiring, piping, fire suppression, etc., needs and are not stackable.

In some embodiments, a length, width, and height of each ISM constitutes a volume of the ISM. In some embodiments, a volume of each ISM is from about 3500 cubic feet to about 5000 cubic feet. In some embodiments, a volume of each ISM is from about 1500 cubic feet to about 2500 cubic feet. In some embodiments, a volume of each ISM is less than about 10,000 cubic feet.

In some embodiments, a weight of each ISM may be measured in a fully loaded state (e.g., including all functional components and equipment), an unloaded state (e.g., an ISM without some functional components or equipment), or at a lightest state (e.g., an ISM without all functional components or equipment). In some embodiments, a weight of each ISM is heavier in a fully loaded state as compared to each ISM in an unloaded or lightest state. In some embodiments, a weight of each of the ISMs may be the same or different. In some embodiments, a weight of each ISM is configured to accommodate transportation, shipping, and/or assembly/lifting requirements.

In some embodiments, a shape of each ISM may be linear. In some embodiments, a shape of each ISM may be non-linear (e.g., a pod, circular, spherical). In some embodiments, the one or more ISMs may include linear ISMs and non-linear (e.g., a pod, circular, spherical) ISMs. As will be described herein, the shape of the ISMs may be configured to adapt to and conform to the shape of a specific building or facility that house one or more application environments.

Figure 3A:
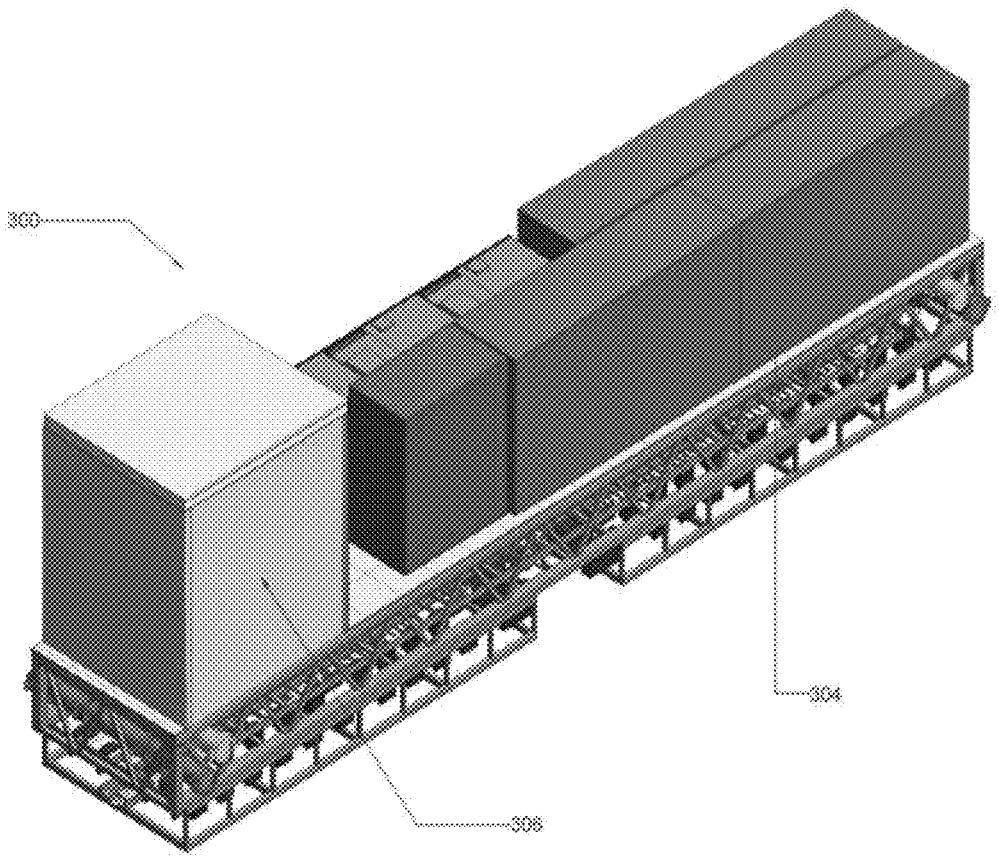
FIGS. 3A-3B illustrate ISMs with different functional components, in accordance with some embodiments.
Figure 3B:
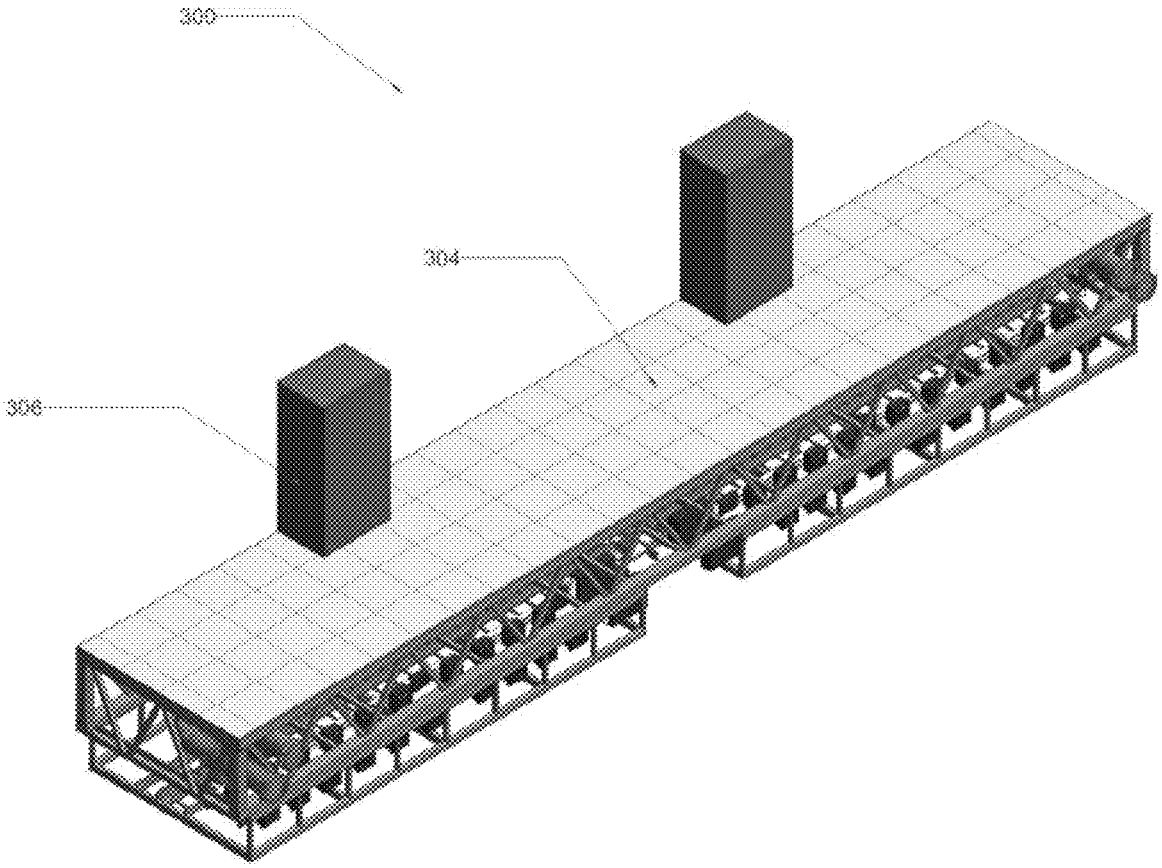

FIGS. 3A-3B illustrate ISMs 300 with different functional components 306 located/supported on a top surface of the structural floor 304. As shown in FIG. 3A, the functional component on the top surface of the structural floor 304 may be electrical power equipment. In some embodiments, the ISM may be a Primary Electrical ISM. In some embodiments, the Primary Electrical ISM may provide up to 10 MW or more of power. In some embodiments, the power capacity of the Primary Electrical ISM may be determined by the physical size of the ISM. For example, a larger ISM may provide a higher power capacity and a smaller ISM may provide a lower power capacity. In some embodiments, one or more ISMs may be configured to support electrical power equipment to provide an uninterruptable power supply to one or more devices/elements of an application environment. For example, the application environment may be a data center and one or more ISMs may be configured to have electrical power equipment to provide an uninterruptable power supply to the data center. In some embodiments, the electrical power equipment may comprise a battery room, an uninterruptable power supply (UPS), and a static transfer switch (STS). In some embodiments, the battery room may be configured to store one or more batteries. In some embodiments, the one or more batteries may be stored to provide supplemental power to the application environment. In some embodiments, the one or more batteries may be stored to provide sufficient power supply to the application environment in a situation where the normal power supply in a facility has gone out. In some embodiments, the one or more batteries may be charged by the normal power supply in a facility or from one or more renewable energy sources (e.g., a solar or wind source). In some embodiments, the ceiling package of the ISM may house the necessary cabling to couple the electrical power equipment to the application environment. For example, the application environment may be a data center and the ceiling package may be configured to house the necessary connections between the electrical power equipment and the servers, storage devices, and/or networking gear that are in the data center. In some embodiments, the Primary Electrical ISMs may be configured to provide 2N (e.g., where N is the amount of power required to run the one or more application environments and 2N means if one power supply goes down or requires maintenance, the other is there to fill in) amount of electrical power. In some embodiments, the Primary Electrical ISMs may be configured to provide higher or lower amounts of electrical power depending on the power requirements of the application environment.

As shown in FIG. 3B, the functional component 306 on top of the structural floor 304 may be network and fire suppression equipment. In some embodiments, the ISM may be referenced to as an Accessory ISM. As an example, the application environment may be a data center. In some embodiments, the one or more ISMs may be configured to store fire suppression equipment as required by code (e.g., local, regional, or national code). For example, the fire suppression equipment can quickly put out any fire that may come from the application environment. In some embodiments, the one or more ISMs may house the necessary fire suppression, network equipment, and other functions not contained in any other ISM. For example, the ceiling package may contain a fire repellant and the ceiling package may house the necessary equipment to apply the fire repellant to the application environment.

Looking back to FIG. 3A, as an additional example, the ISM supporting electrical power equipment 306 on top of the structural floor 304 May be a Reserve Power ISM. In some embodiments, the Reserve Power ISM can provide at least 1.0 kW of power up to 10 MW of power. In some embodiments, the power capacity of the Reserve Power ISM may be determined by the physical size of the ISM. For example, a larger ISM may provide a higher power capacity and a smaller ISM may provide a lower power capacity. In some embodiments, the application environment can be configured to have one Reserve Power ISM. In some embodiments, the application environment can be configured to have more than one Reserve Power ISM. In some embodiments, the application environment can be configured to have a ratio of Reserve Power ISMs to Primary Power ISMs from 1:1 to 1:N (whereby N is any integer greater than 2) Primary Power ISMs. As shown, the electrical power equipment may comprise a battery room and a distribution panel. In some embodiments, the battery room may be configured to store one or more batteries. In some embodiments, the one or more batteries may be stored to provide supplemental power to the application environment. In some embodiments, the one or more batteries may be stored to provide sufficient power supply to the application environment in a situation where the normal power supply in a facility has gone out. In some embodiments, the one or more batteries may be charged by the normal power supply in a facility or from one or more renewable energy sources (e.g., a solar or wind source). In some embodiments, the distribution panel may be configured to distribute energy to the application environment or to the one or more other ISMs. For example, there may be one or more ISMs comprising functional components requiring electrical power. One or more ISMs comprising a distribution panel may be connected to one or more other ISMs (e.g., in an assembly or sub-assembly of ISMs, as will be described herein) to provide power to those functional components. In some embodiments, the ceiling package and/or the MEP package may be configured to include the necessary cabling and connections to connect between the one or more ISMs.

In some embodiments, the one or more ISMs utilize a platform base that enables interchangeability and/or upgrades of functional components within an ISM, and between different ISMs. For example, an ISM may be configured to utilize electrical power equipment, as described above. In some embodiments, the electrical power equipment may be taken off and replaced with a CDU or fire suppression equipment. This greatly improves the modularity and applicability of the one or more ISMs to the different application environments. This allows individual components to be replaced (e.g., at a micro level) instead of replacing an entire ISM with a new ISM (e.g., at a macro level). In some embodiments, an ISM may be replaced with a new ISM. In some embodiments, the application environment may be a data center and the one or more ISMs may comprise CDUs, cooling equipment, fire suppression equipment, MPE packages, ceiling packages, and electrical power equipment. As an example, the data center may expand and have increased needs for cooling. One or more ISMs may be modified to support cooling equipment to increase cooling capacity. Or, when a data center grows, it may have an increased power demand. One or more ISMs may be modified to support electrical power equipment to satisfy the need. As another example, the electrical power equipment of one or more ISMs may break down. In some embodiments, new electrical power equipment may replace the broken equipment on the existing ISM.

In some embodiments, a cooling system is implemented amongst the one or more ISMs. In some embodiments, the cooling system is a closed-loop water based cooling system. In some embodiments, the cooling system is an open-loop water based cooling system. In some embodiments, the water is sourced from a natural source of water such as from a river, ocean, lake, or other suitable body of water.

As an example, the application environment may be a data center. In some embodiments, a data center is a facility designed to house, maintain, and power a plurality of computer systems. The computer systems within the data center are generally rack-mounted within a support frame referred to as a rack. The data center is defined (e.g., as based on requirements or expectations set forth via a service level agreement (SLA)) to maintain interior ambient conditions suitable for proper operation of the computer systems therein.

A key constraint of the data center is cooling capacity. Each watt consumed by the computer systems is a watt of waste heat that must be removed to maintain suitable operating temperature. Conventional data centers employ a variety of cooling technologies, including refrigerant and water-based air cooling systems. These systems have varying ranges of efficiency and in some cases account for more than 30% of the total power consumed in the data center.

As power density in data centers continues to increase, data center providers often struggle with cooling demands that can quickly outstrip the data center capabilities. In some embodiments, the cooling systems described herein provide increased cooling capacity capabilities.

In some embodiments, the open-loop and/or closed-loop systems described herein may include cooling systems as disclosed in U.S. Pat. Nos. 9,784,460; 11,246,243; 10,111,361; 10,470,342; 9,439,322; 9,814,163; 10,437,636; 11,182,201; 10,178,810; 11,102,915; 10,673,684; 11,224,145; or U.S. patent application Ser. Nos. 16/934,001; 17/588,363; 16/022,030; 17/524,749; 17/542,491; 17/381,182; 15/972,066; or 17/460,672; all of which are incorporated by reference in their entirety herein.

Figure 4A:
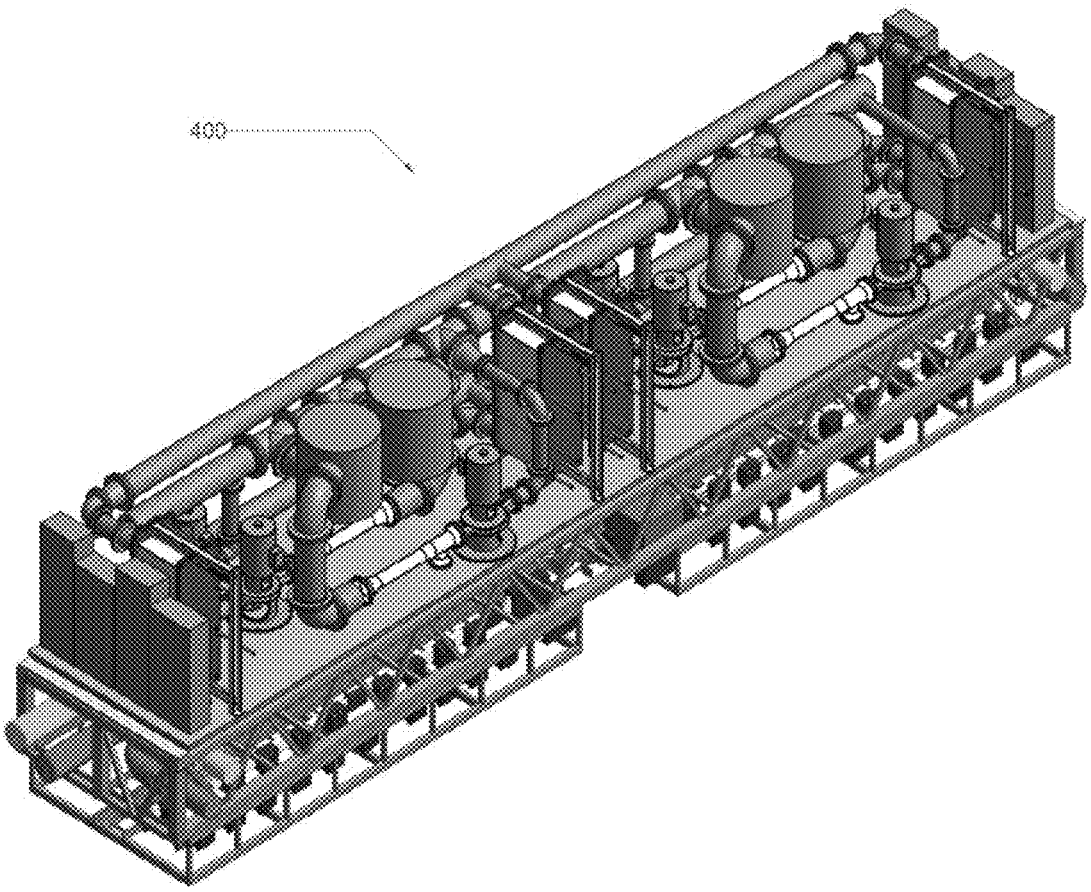
FIGS. 4A-4B are a perspective view of a Cooling Distribution Unit (CDU), in accordance with some embodiments

As illustrated in FIG. 4A, an ISM may be configured to support one or more cooling distribution units (CDUs) 400 on top of the top surface of a structural floor. One or more ISMs in an ISM assembly may be configured to have one or more CDUs to facilitate the cooling of the application environment. For example, the CDUs may connect to the open and/or closed loop water based cooling systems and provide the cooling water throughout the individual ISMs in the ISM assembly, which may then provide the cooling water to the application environment below. In some embodiments, each CDU may provide at least about 100 kW to about 10 MW of cooling capacity. In some embodiments, the cooling capacity of each CDU can be configured to be higher or lower to accommodate the cooling requirements of the application environment. In some embodiments, the number of CDUs included in an application environment may be at N+1 (e.g., wherein N is the cooling capacity required to run the one or more application environments, and N+1 is the cooling capacity needed to run the one or more application environments taking into account an additional component to compensate for the failure or maintenance of one CDU). In some embodiments, the cooling system (e.g., number of CDUs included in an application environment) may be configured to provide N, N+1, N+2, N+3, N+4, or N+5 or more, or 2N, 3N, 4N, or 5N or more cooling capacity.

Figure 4B:
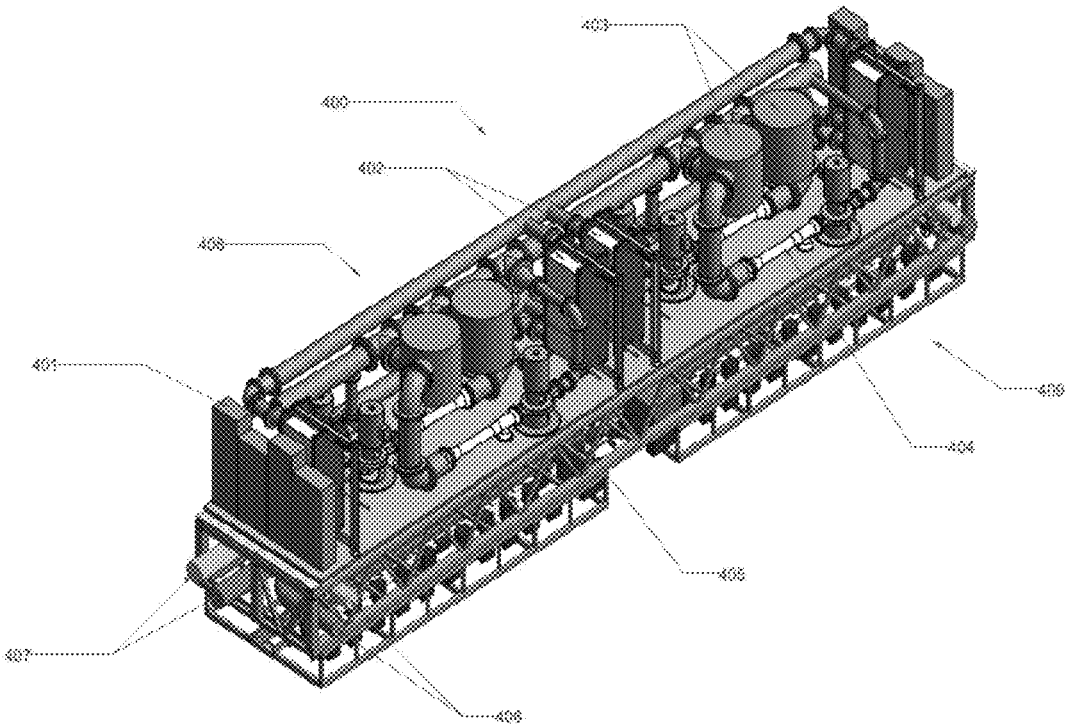

As illustrated in FIG. 4B, the one or more CDUs 400 may comprise a MEP power distribution 401, a heat exchanger 402, a buffer tank 403, a venturi 404, a pump 405, closed loop piping 406, and open loop piping 407. As shown, the piping necessary for the cooling system may be housed in the MEP package space in the interstitial space below the top surface of the structural floor. In some embodiments, the piping necessary for the cooling system may span between the MEP space of several ISMs and connect to the application environment via the connections of the ceiling package to provide the necessary cooling to the application environment. Integrating the plumbing and CDUs required for the cooling system into the one or more ISMs simplifies the installation and startup of the assembly of ISMs. In some embodiments, as shown in FIG. 4B, 4 CDUs may be consolidated on dual-CDU skids. Dual CDUs 408 and 409 may be included on the dual-CDU skid such that the skid may comprise 4 CDUs. In some embodiments, the one or more CDUs are located above a closed loop system. This may reduce entrained air and may simplify installation and startup.

Figure 5A:
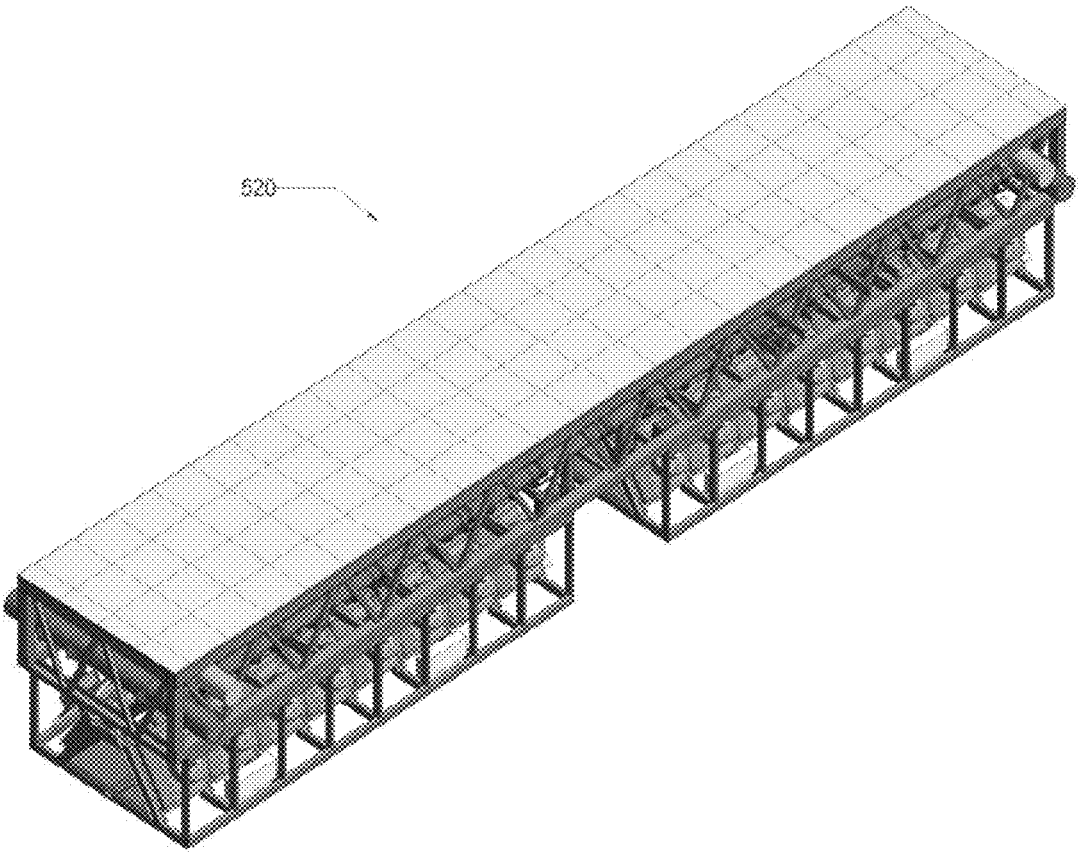
FIGS. 5A-5B are a perspective view of cooling equipment in accordance with some embodiments.
Figure 5B:
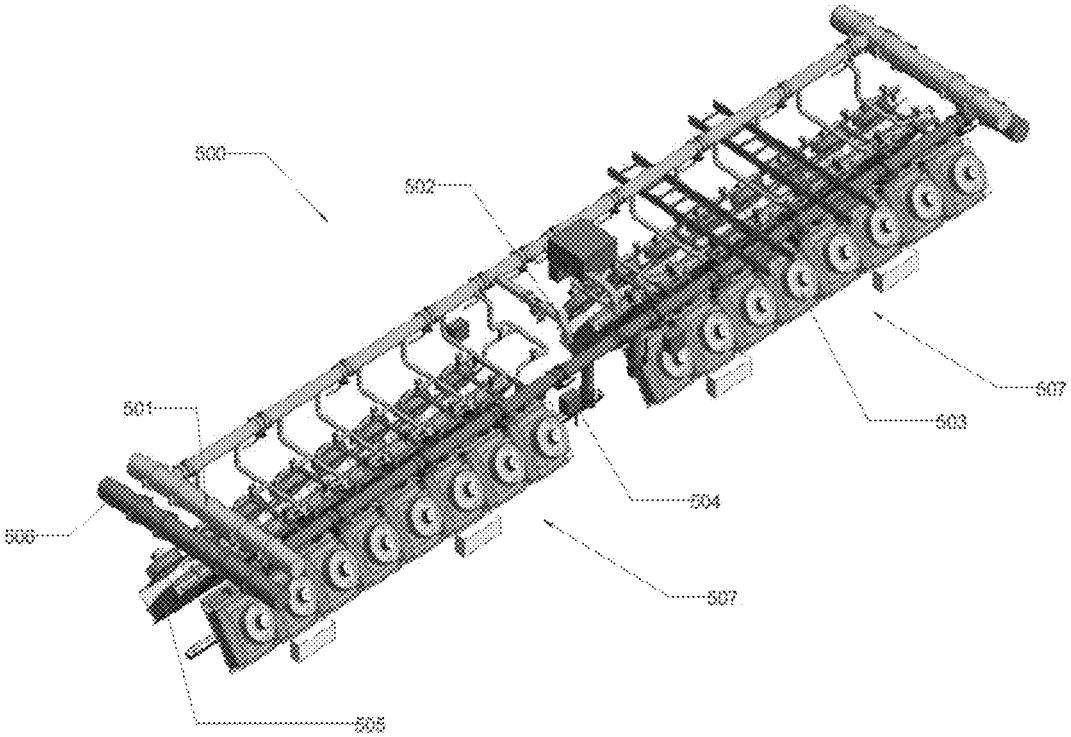
Figure 5C:
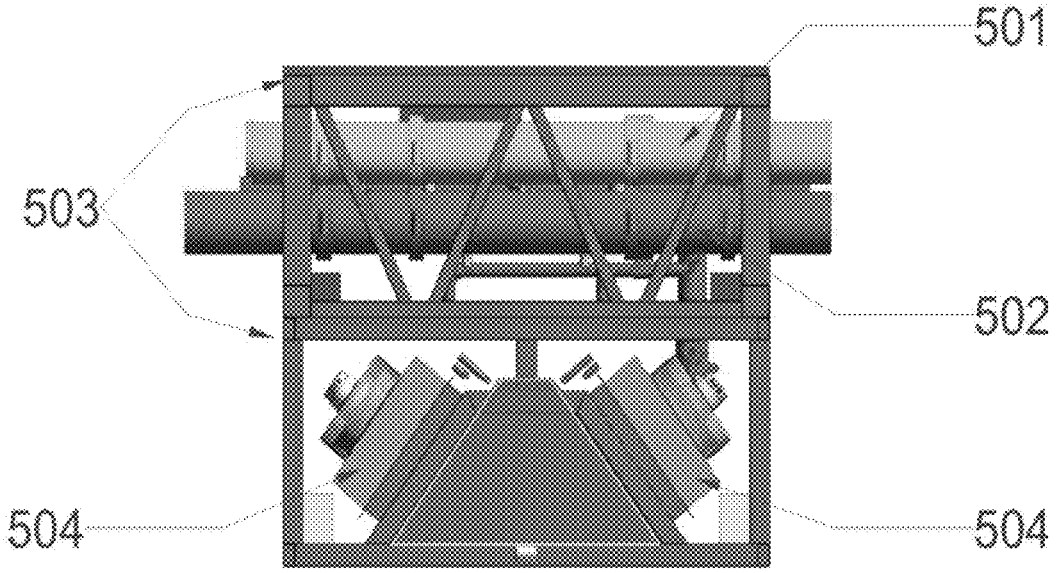
FIG. 5C is a cross-sectional view of a cooling equipment, in accordance with some embodiments.

FIGS. 5A-5C illustrate a further example of cooling equipment 500 that may be implemented in one or more embodiments herein. As shown in FIG. 5A, the cooling equipment may be configured to be supported beneath the top surface of the structural floor of the ISM 520. In some embodiments, the cooling equipment is contained in the ceiling package with distribution piping contained in the interstitial space. In some embodiments, the ISM shown in FIGS. 5A-5C have no functional components on top of the structural floor of the ISM. In some embodiments, the ISM shown in FIGS. 5A-5C has any one or more of the functional components described herein. In some embodiments, the cooling equipment may be hot aisle cooling equipment. In some embodiments, the cooling equipment is connected to one or more CDUs on top of the structural floor. In some embodiments, the cooling equipment of FIGS. 4A-4B, and FIGS. 5A-5C may make up a cooling system. In some embodiments, the application environment is a data center comprising a plurality of cabinets. In some embodiments, the cooling system can be configured to accommodate the cooling requirements of an application environment. For example, the application environment can be a data center and the cooling system can be configured to provide the required cooling based on a number of data racks, and number of cabinets per data rack, included in the data center. In some embodiments, rear doors may be added to the cooling system for higher density cooling.

As shown in FIG. 5B, the cooling equipment may comprise 2 pods 507 that contain up to 20 racks in each pod. In some embodiments, the cooling equipment provides a hot aisle cooling system. The hot aisle cooling system may be implemented to control and optimize airflow in the data center by isolating the heated air exhausted from one or more application environments and conditioning the hot air with a cooling unit (e.g., as described herein) that is close to the heat source (e.g., above the heat source). In some embodiments, the hot aisle cooling systems described herein may include hot aisle cooling systems as disclosed in U.S. patent application Ser. No. 16/022,030, which is incorporated by reference in its entirety herein.

Figure 12A:
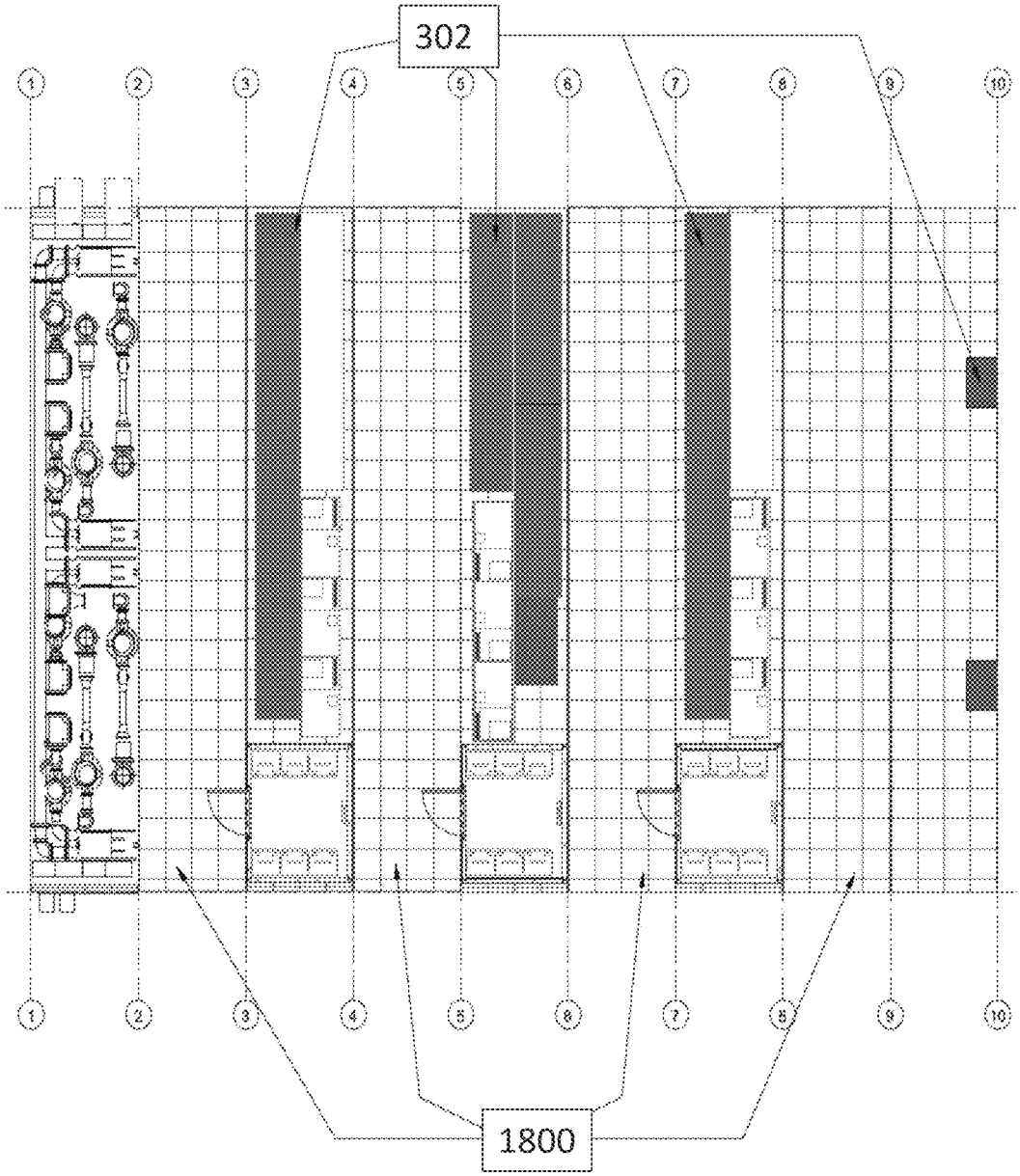
FIG. 12A is a top down view of an ISM system, in accordance with some embodiments.
Figure 12B:
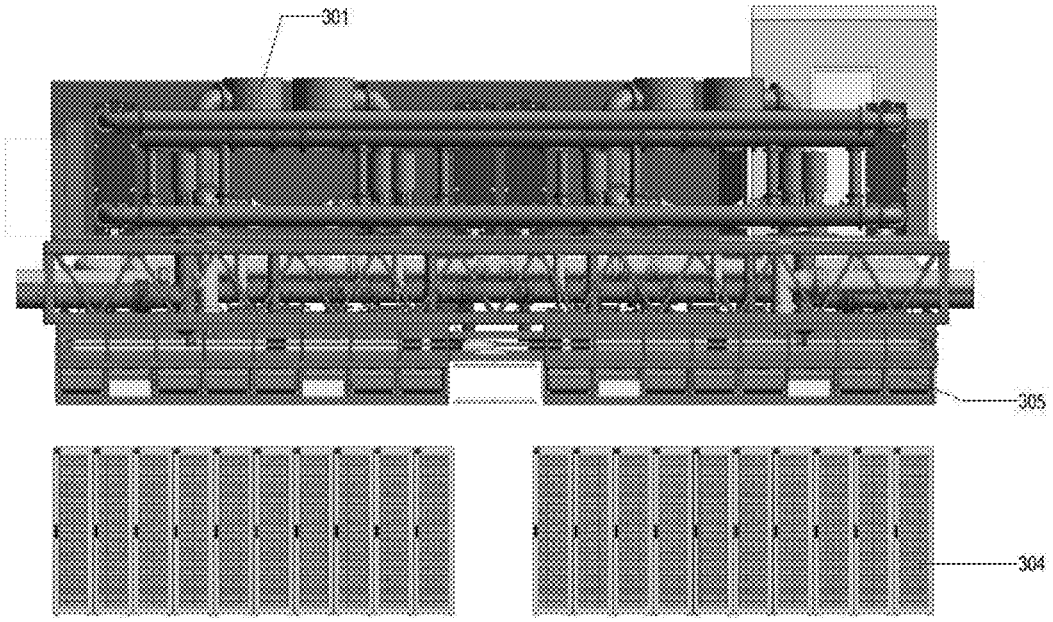
FIG. 12B is a cross-sectional view of an ISM and application environment, in accordance with some embodiments.

In some embodiments, the pod configuration (e.g., number of pods, number of racks in each pod, and size of racks) can be configured to accommodate the cooling requirements of an application environment. For example, the application environment can be a data center and the pod configuration can be configured to provide the required cooling based on a number and size of data racks, and number of cabinets per data rack, included in the data center. In some embodiments, the pod configuration can be configured to follow industry standards based on safety ingress/egress requirements. In some embodiments, the pods 507 are contained within the MEP and/or interstitial space of the ISM. In some embodiments, the pods 507 extend below the MEP and/or interstitial space of the ISM. As illustrated in FIG. 12B, the pods 305 extend below the MEP and/or interstitial space and extends towards the application environment 304. In some embodiments, the pods 507 are contained in the ceiling package of the ISM. In some embodiments, the ceiling package contains the necessary connectors to connect the pods 507 to the application environment. In some embodiments, an ISM may not, or need not have any functional components 301 on top of the structural floor. Instead, the functional component(s) of the ISM may be entirely contained, situated, or located below the structural floor (for example, within the interstitial space, and/or below the interstitial space). In some embodiments, such ISMs may be more common and make up a larger proportion of modules than other ISM designs withing a given system. Housing the cooling equipment in the ISM greatly improves installation (e.g., reduces the number of plumbing connections required) and move in of the ISM and cooling system and also may improve operation and maintenance. This may also simplify operation and maintenance of the ISMs as compared to state of the art systems. In some embodiments, there may be a reduction (e.g., optimization) in the number of plumbing connections required as compared to state of the art systems for a cooling system (e.g., a liquid cooling or chilled water system). In some embodiments, the plumbing may take advantage of quick connect couplers and valves, including Victaulic® connections/connectors, for rapid assembly and to reduce: (i) the number of couplers/valves needed in a system, and (ii) the difficulty of connecting the system. For example, the quick connect couples and valves may include mechanical grooved couplings configured to join mechanical pipes together to create a watertight joint.

Figure 5D:
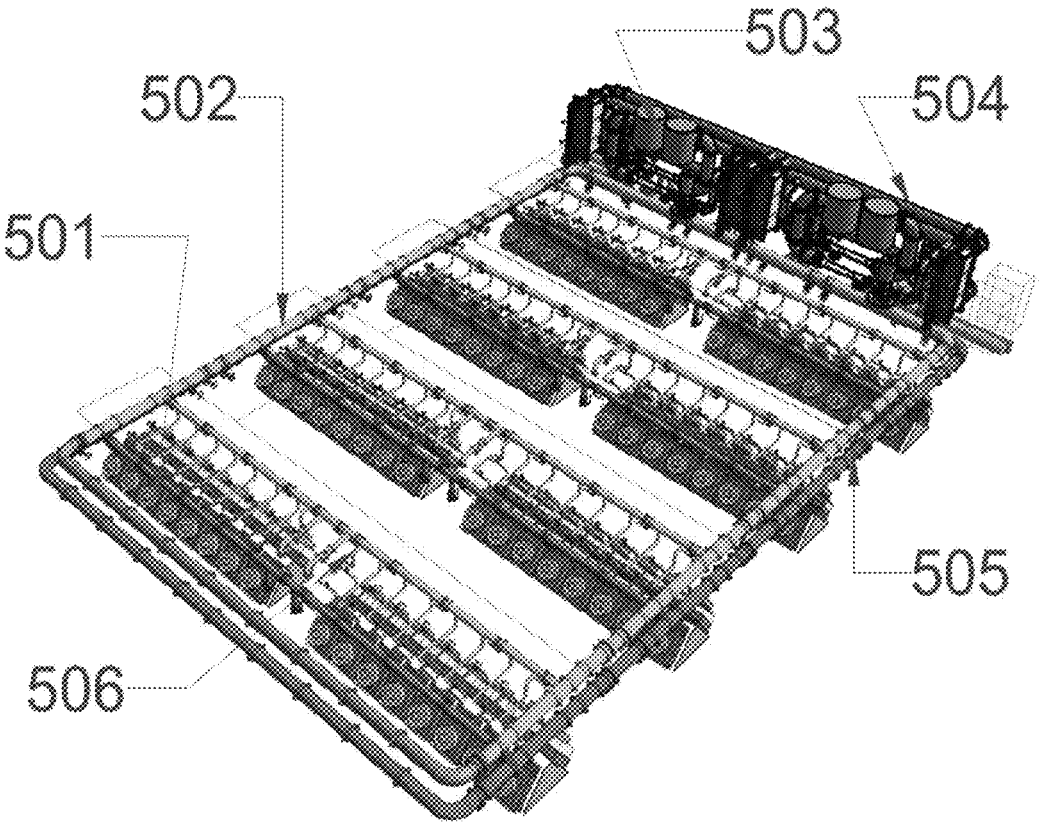
FIG. 5D is a perspective view of a cooling system, in accordance with some embodiments.

As shown in FIG. 5D, the cooling equipment also may comprise a closed loop supply 501, a spare takeoff valve 502, fans 503, controls 504, one or more coils 505, and a closed loop return 506. In some embodiments, the plumbing required for the cooling equipment is housed/enclosed in the MEP and/or interstitial space located beneath the top surface of the structural floor of the ISM.

In some embodiments, cooling equipment may be configured to implement rear door cooling system, an immersion cooling system, and/or a direct to chip cooling system in addition to the hot aisle cooling. In some embodiments, the ceiling package of the ISM contains the necessary connectivity to connect the cooling equipment of the one or more ISMs to the rear door, immersion, and/or direct to chip cooling systems.

In some embodiments, a rear door cooling system is used for removing a heat load from the application environment. As an example, the one or more application environments may comprise a data center, and the rear door cooling system can remove the heat from an IT load of the data center. In some embodiments, a rear door heat exchanger may be configured to attach to a rear of each of one or more data racks in the data center. In some embodiments, each rear door heat exchanger is configured to cool the hot air exhausted from the rear of each of the one or more data racks in the data center.

In some embodiments, an immersion cooling system is used for removing a heat load from the application environment. As an example, the one or more application environments may comprise a data center, and the immersion cooling system can remove the heat from an IT load of the data center. In some embodiments, one or more components (e.g., electrical components, pieces of hardware) of the data center may be immersed in a non-conductive liquid to provide increased cooling capacity as compared to air cooling. In such cases, the heat generated by the components of the data center is directly and efficiently transferred to the fluid. Immersing the components of the data center in the fluid may also protect the components from airborne particulates, humidity, oxidation, and eliminates fan vibration (e.g., such as fan vibration caused from an air cooled system).

In some embodiments, a direct to chip cooling system is used for removing a heat load from the application environment. As an example, the one or more application environments may comprise a data center, and the direct to chip cooling system can remove the heat from an IT load of the data center. In some embodiments, cooling components are applied directly to one or more data center components (e.g., computer chips, CPUs, GPUs, memory modules, servers, etc.) and a liquid coolant is applied to the one or more components to directly absorb the heat generated by the one or more components.

In some embodiments, each pod provides an amount of cooling capacity, and a sum of the cooling capacity of each pod in a given application environment can be configured to provide the necessary cooling capacity requirements of the given application environment.

In some embodiments, the cooling equipment in FIG. 5B may include additional equipment (e.g., cooling doors) which can increase the heat exchange over a targeted area. In some embodiments, the one or more ISMs can be configured to use the same cooling media as the rest of the cooling equipment in an application environment (e.g., cooling doors and the cooling equipment in the ISMs can draw from the same water source).

In some embodiments, the cooling equipment is included such that it provides N+2 (e.g., wherein N is the cooling capacity required to run the one or more application environments, and N+2 is the cooling capacity needed to run the one or more application environments taking into account two additional components to compensate for the failure or maintenance of two pieces of cooling equipment). In some embodiments, the cooling equipment is included such that it provides N+2, N+3, N+4, or N+5 cooling capacity for the one or more application environments.

FIG. 5C illustrates a cross-sectional view of the cooling equipment integrated into the ISM. Coolant pipes/plumbing (e.g., cool water in and hot water return pipes) 501 and 502 may be in the interstitial space below the structural floor of the ISM enclosed by the steel truss 503. The racks 504 are shown extending beneath the interstitial space of the ISM.

FIG. 5D illustrates a cooling system 500 that includes ceiling cooling package 501, a closed loop supply 502, CDUs 503 and 504, a closed loop return 505, and spare takeoff valves 506. The CDUs 503 and 504 may be integrated onto an ISM, as described herein. The remaining equipment, including 4 individual pieces of cooling equipment with connected plumbing as described in FIGS. 5A-5C, may be implemented in the interstitial space and MEP package and ceiling package areas of 4 ISMs, as described herein. Constructing a system of cooling ISMs in this manner greatly reduces the time to install and also greatly reduces the amount of time/labor required to install cooling system piping as the modular ISM nature allows for most of this construction/fitting to be completed at the manufacturing facility. This greatly saves on-site time/money/labor to install. In this way, an entire sub-assembly of ISMs can be configured to provide cooling to the application environments associated with the ISMs.

Figure 6:
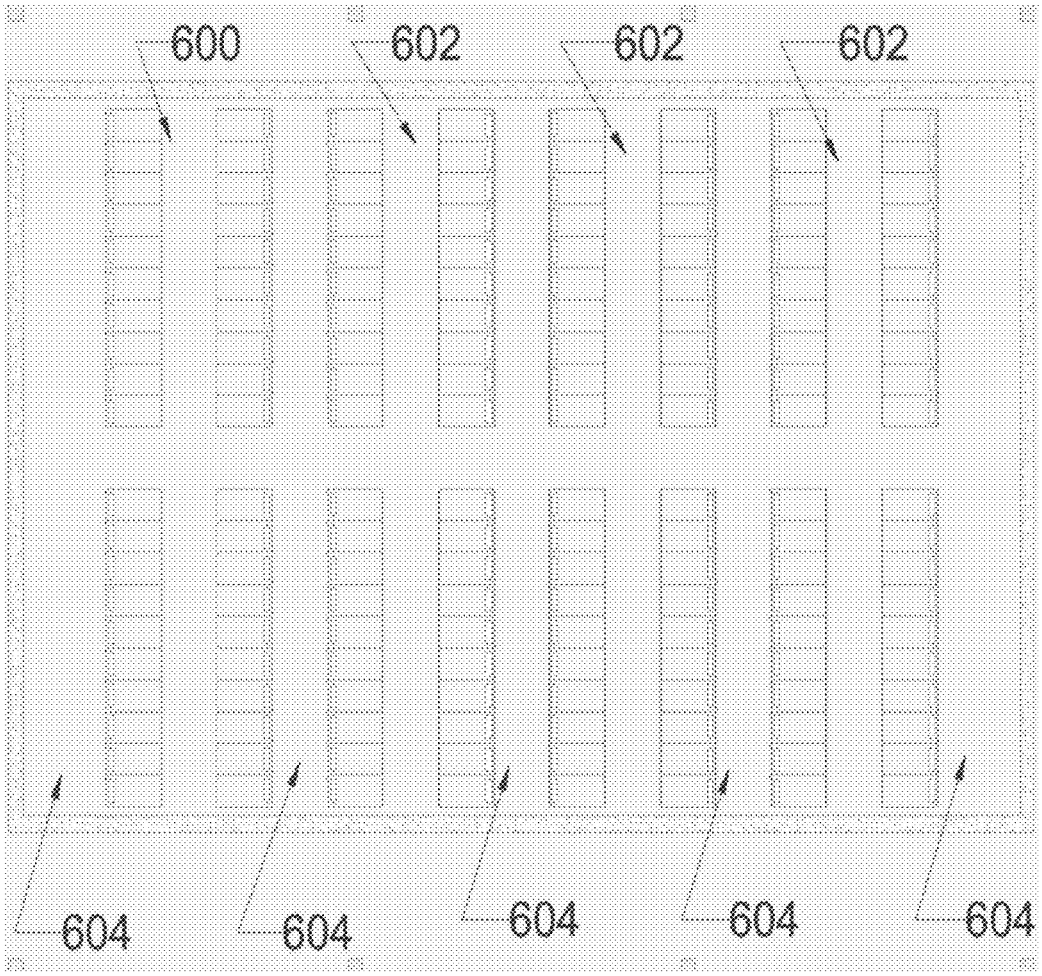
FIG. 6 is a top down view of a data center in accordance with some embodiments.

FIG. 6 is a top down view of a data center comprising data racks configured such that hot aisles 602 and cold aisles 604 are created. One or more hot aisle cooling ISMs may be configured to rest directly above the hot aisles 602 to perform the hot aisle cooling. In some embodiments, the aisle widths can be configured to accommodate industry standards of standard aisle widths, such as to accommodate server removal and installation. The widths of the aisles may be configured to accommodate a variety of industry standard cabinets, including custom cabinets built for a particular data center. In some embodiments, the number of cabinets per aisle can be configured to accommodate industry standards, such as to accommodate server removal and installation.

In some embodiments, the application environment may require that one or more functional components of the ISM be sealed. In some embodiments, the application environment may require that the ISM level seal off a portion of the application environment. In some embodiments, the structural floor of the ISM may comprise a sealed portion that is impervious to air, gases, and/or liquids. In some embodiments, at least one of the first, second, or third functional components is sealed. In some embodiments, the second functional component is sealed within a top portion or a bottom portion of the interstitial space of the ISM. For example, an application environment may comprise a manufacturing facility accommodated to manufacturing fragile or complex products (e.g., semiconductors) that require a sterile environment in one or more steps in the manufacturing process. Sealing off one or more of the functional components, or sealing off a portion of the manufacturing facility with the one or more ISMs, may provide the necessary sterile environment required for the specific manufacturing step.

In some embodiments, the structural floor and/or the interstitial space of an ISM defines an elongated continuous zone, wherein at least a portion of the elongated continuous zone is configured to either permit or restrict access to human operators or users. FIG. 12A, illustrates a top down view of an assembly, or sub-assembly, of ISMs, as will be described herein. As illustrated in FIG. 12A, the assembly of ISMs includes continuous zones 1800 defined by the structural floor of the assembly of ISMs. In this embodiment, the continuous zones 1800 allow for a human operator to walk in between the individual ISMs 302. This may allow for a human operator to access the individual ISMs to repair and maintain the ISMs. This may also provide human operator access to take out and replace individual functional components of the ISMs with new or upgraded functional components. This greatly increases the ease of access for maintenance personnel and reduces the amount of time and cost required to repair, maintain, or replace an ISM, or functional components of an ISM. The continuous zones 1800 may also be configured to accommodate clearance requirements necessitated by any equipment (e.g., electrical panels) included in the ISMs.

In some embodiments, at least a portion of the ISMs or the structural floor is configured to serve as a walkway for human operators or users. As shown in FIG. 12A, the continuous zones 1800 of the structural floor define walkways for human access. In some embodiments, at least a portion of the walkway is removable or detachable, so as to enable access to an interstitial space beneath a surface of the structural floor. This feature greatly increases the ease with which an operator can access the equipment included beneath the structural floor. This can increase the ease with which component beneath the structural floor may be repaired, maintained, or replaced with new or upgraded components.

In some embodiments, the one or more ISMs are configured to accept a walkway structure that is attached thereto. For example, this may form a walkway between one or more functional components that is a separate component to the one or more ISMs. In some embodiments, the equipment between adjacent ISMs are separated by spaces in-between, and wherein at least some of the spaces are configured to function as walkways for human operators or users.

Figure 7:
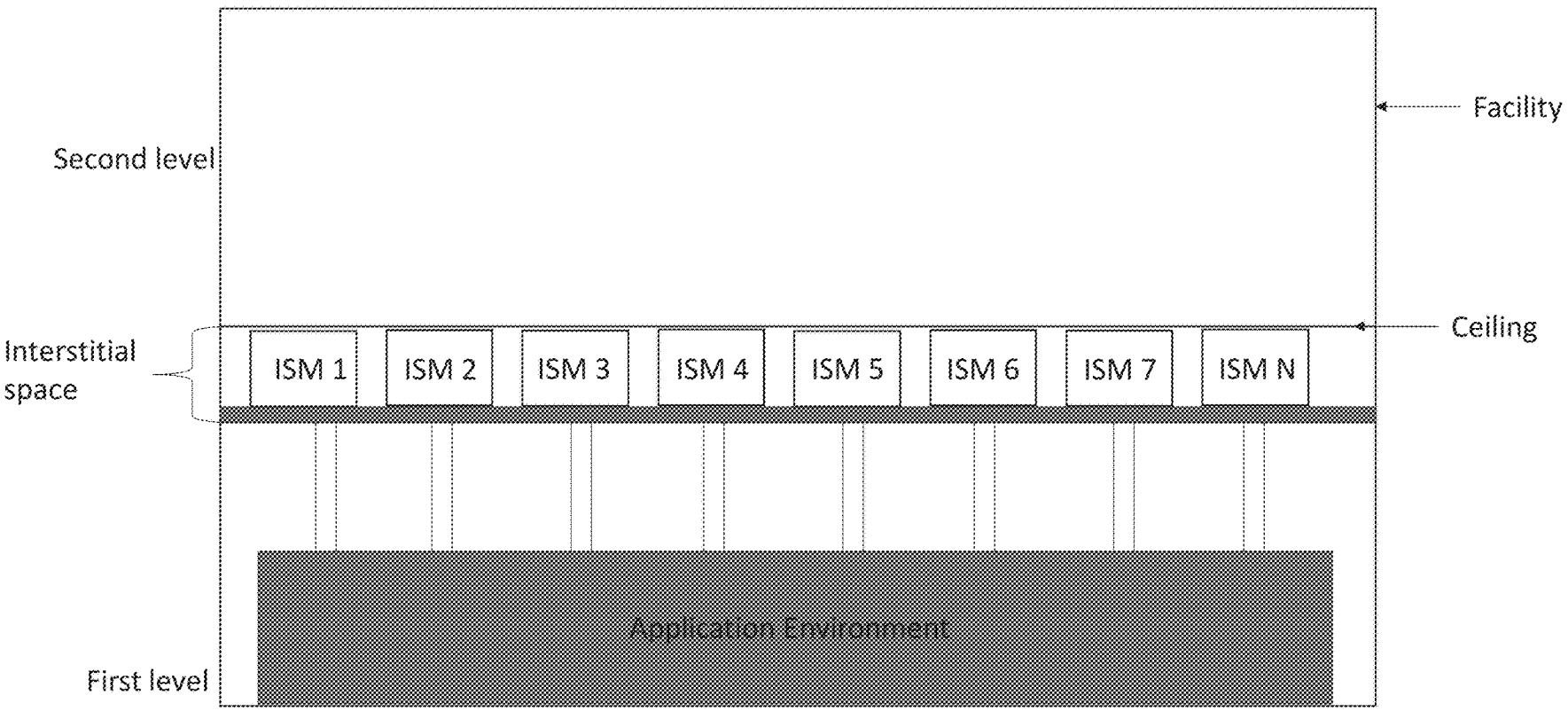
FIGS. 7-8 are block diagrams for ISMs integrated with an application environment, in accordance with some embodiments.
Figure 8:
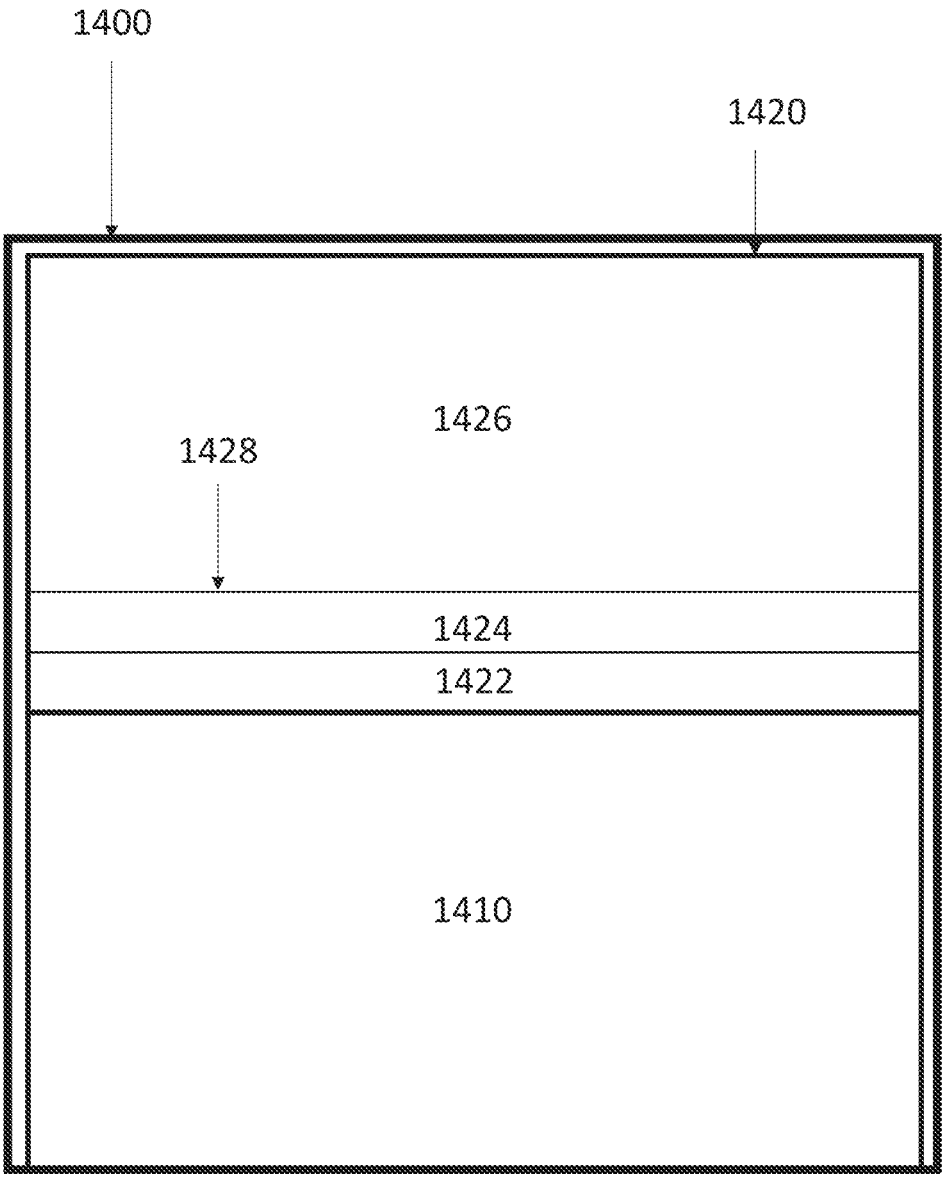

FIGS. 7-8 are block diagrams illustrating ISMs/ISM systems (e.g., assembly and/or sub-assembly of ISMs) integrated with an application environment inside a facility. In some embodiments, the one or more ISMs are assembled to form one or more levels within the one or more application environments. In some embodiments, the one or more levels are located configured to increase vertical density and reduce one or more of an area, volume, or space footprint of the one or more application environments. In some embodiments, wherein individual ISMs on the one or more levels are removable or replaceable. In some embodiments, the one or more levels are configured to separate or divide a volume or space within the one or more application environments. In some embodiments, the one or more levels comprise a porous layer that is permeable to air, gas or a fluid. In some embodiments, the one or more levels comprise a barrier layer that is impermeable to air, gas or a fluid. In some embodiments, the one or more levels comprise at least one level that comprises or forms an interstitial space.

As shown in FIG. 7, in some embodiments, an application environment may be located on a first level of a facility and the one or more ISMs may be assembled and span an interstitial space below a ceiling of the first level and above the application environment. A second level of the facility may be located above the ceiling and contents of the first level. In some embodiments, the facility may/need not have a second level. In some embodiments, the one or more ISMs are directly abutted to one another to create a structural floor of the second level. In some embodiments, the one or more ISMs may be assembled directly below the ceiling of the first level to form a floor of the second level. This may reduce costs and time associated with having to specially construct a second level for placing equipment and retrofitting it to incorporate the functional components described herein (e.g., cooling systems, power distribution systems, etc.). In some embodiments, the application environment may comprise a data hall located on a first level, and wherein the one or more ISMs are assembled in the interstitial space below a ceiling of the first level and above the data hall. In some embodiments, a configuration of the ISMs in the interstitial space is adjustable. In some embodiments, individual ISMs in the interstitial space are removable or replaceable.

In some embodiments, the application environment may be on a second level of the facility such that the application is above one or more ISMs. In some embodiments, the one or more ISMs are assembled in the interstitial space above the floor of the second level and below the application environment.

In some embodiments, there may be two application environments. One application environment may be located on a first level, and a second application environment may be located on a second level. The one or more ISMs may be assembled in the interstitial space above the floor of the second level and below the application environment in the second level.

In some embodiments, the height of the application environment on the first level may be increased. The height of the application environment may depend on the type of application environment. For example, the height of the first floor may be higher for a data center than the height of the first floor for a manufacturing facility. In any application environment, the height of the second level is adjustable. In some embodiments, the one or more ISMs are assembled in the interstitial space below a ceiling of the first level and above the application environment and can be configured to accommodate the height of the first floor and total height of the facility.

In some embodiments, the first level is a ground level. In some embodiments, the first level is located beneath the ground. In some embodiments, the facility (e.g., water-based data center) may be located on a body of water, and the application environment may be below the water line of the body of water. In some embodiments, a portion of the application environment may be above the water line, and a portion of the application environment may be below the water line. In some embodiments, the application environment may be above the water line.

FIG. 8 illustrates a facility 1400 enclosing a first level 1410 comprising an application environment, and a second level 1420 comprising one or more ISMs. The one or more ISMs may comprise ceiling package 1422, MEP package 1424, structural floor 1428, and one or more additional functional components 1426 on top of the structural floor 1428. As disclosed herein, the one or more additional functional components may comprise electrical power equipment, CDUs, or fire suppression equipment.

Figure 9A:
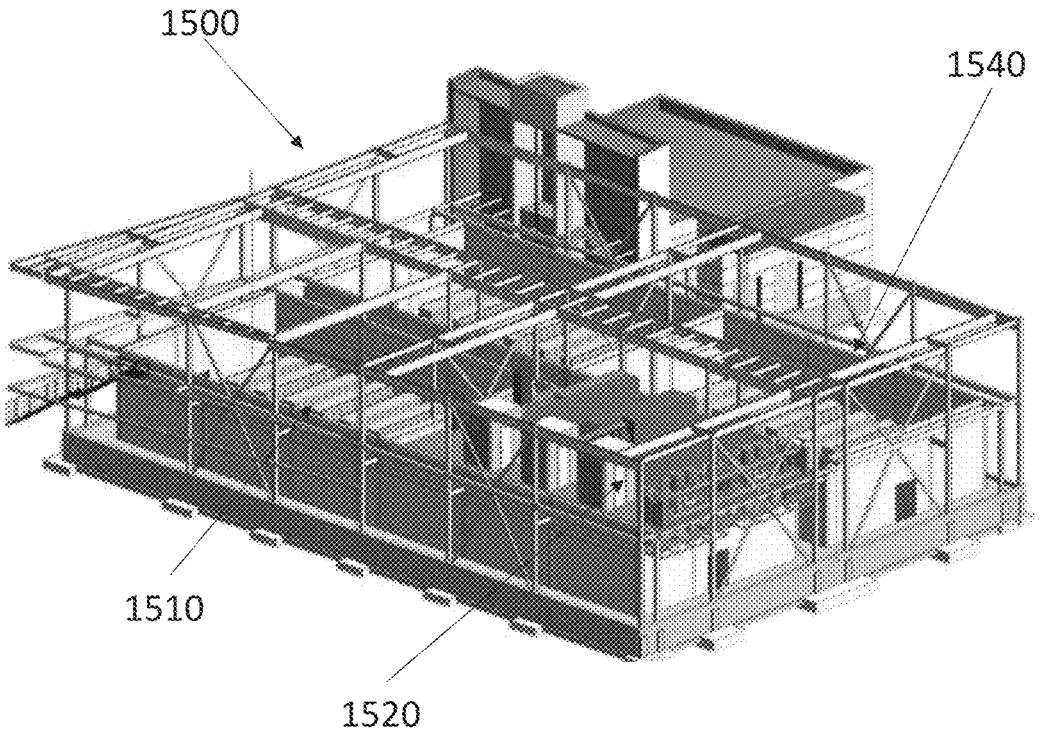
FIG. 9A is a perspective view of a structure housing ISMs and an application environment, in accordance with some embodiments.

FIG. 9A illustrates a perspective view of a facility 1500 configured to house an application environment 1510 on a first level and one or more ISMs 1520 on a second level. In some embodiments, the one or more ISMs are configured to be assembled on-site, without being constrained by a geographical location, shape, size, and/or volume of a space or building (e.g., facility) within which the ISMs are to be assembled. The modularity of the ISMs allow them to adapt to the given facility's size constraints.

In some embodiments, the one or more ISMs are configured to be assembled on-site in regular-shaped buildings or irregular-shaped buildings. In some embodiments, regular-shaped buildings may include rectangular, square, cuboid, spherical, or hemispherical buildings or the like. In some embodiments, irregular-shaped buildings may include amorphous shaped structures or any other building not having a continuous or classified shape. The one or more ISMs can conform to any type of building and are not limited by the specific types and shapes of the building.

In some embodiments, the application environment 1510 of the building 1500 may be configured to accommodate a data center. In some embodiments, the application environment of the building may be desired to be changed. In some embodiments, the one or more ISMs are configured to be assembled on-site for a desired application environment in an existing building, wherein the existing building was previously used as another application environment that is different from the desired application environment. In this way, the ISMs are extremely adaptable and can conform to any type of building housing any type of application environment.

In some embodiments, the one or more ISMs may already be installed when there is a desire the change from one application environment to another application environments. In some embodiments, the one or more ISMs are configured to be interchangeable or swappable, so as to enable a first application environment to be reconfigured, converted or repurposed for a second application environment that is different from the first application environment. In some embodiments, the first application environment may comprise a data center, and the second application environment may comprise a manufacturing facility. In such instances, ISMs for the data center (e.g., comprising CDUs, electrical power equipment, fire suppression equipment, etc., as described herein) may be swapped out for ISMs applicable to the incoming manufacturing facility. For example, the ISMs replacing the data center ISMs may comprise the electrical power equipment, ventilation systems, and or lighting systems, or the like, necessary for the manufacturing facility. In some embodiments, the individual functional components of the ISMs may be swapped, instead of the entire ISM, to accommodate for the new application environment. In some embodiments, the first application environment may comprise a manufacturing facility, and the second application environment may comprise a data enter. In such an instance, the ISMs of the manufacturing facility can be replaced with CDU, electrical power equipment, and/or fire suppression ISMs applicable to a data center, as described herein. In some embodiments, the individual functional components of the ISM may be swapped out to house and accommodate the functional components required for the data center.

In some embodiments, the one or more ISMs are configured to be assembled on-site in a new building that is to be constructed for a desired application environment. The modularity and adaptability of the ISMs allows for more architectural freedom when designing space and shape requirements of the new building.

Figure 9B:
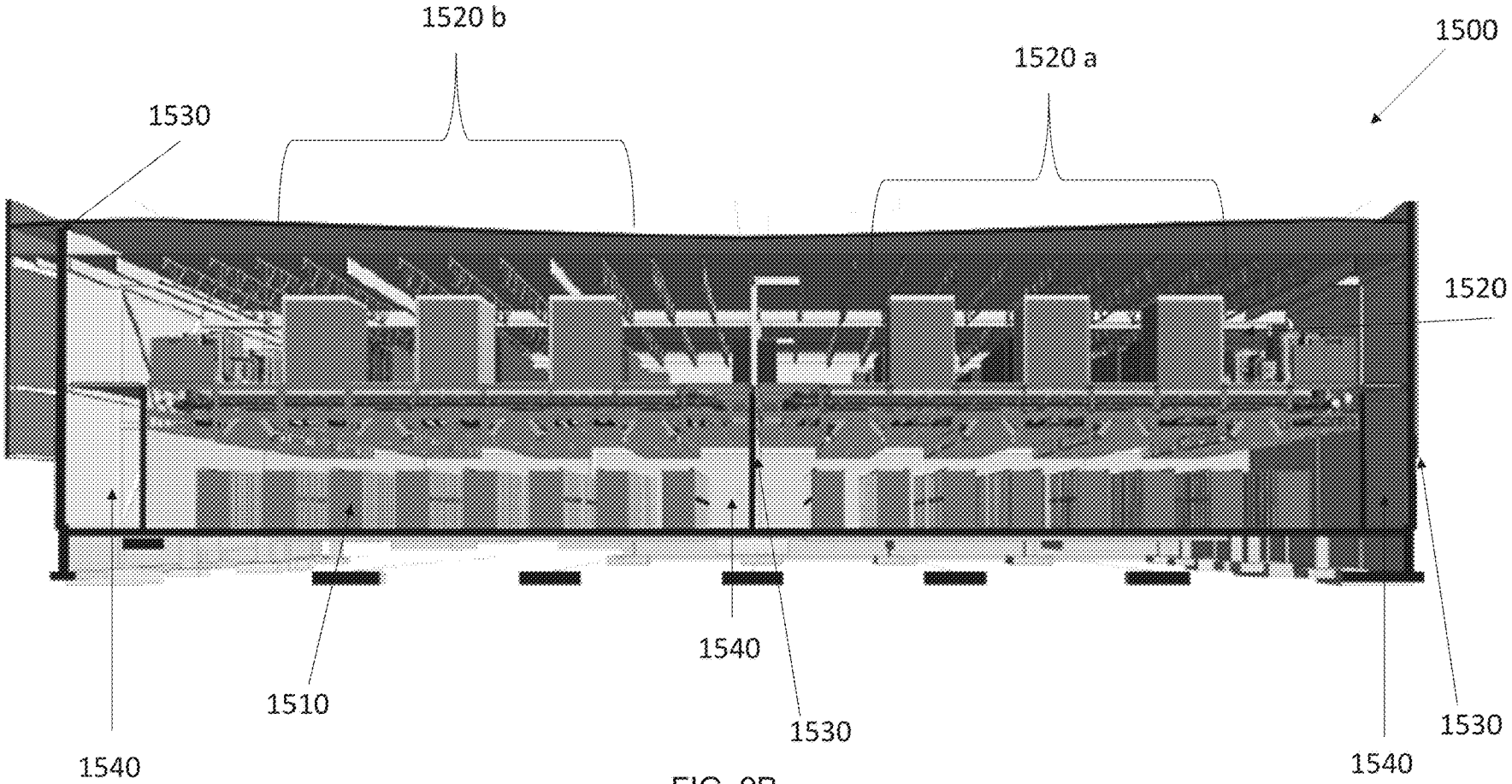
FIG. 9B is a cross-sectional view of a structure housing ISMs and an application environment, in accordance with some embodiments.
Figure 10:
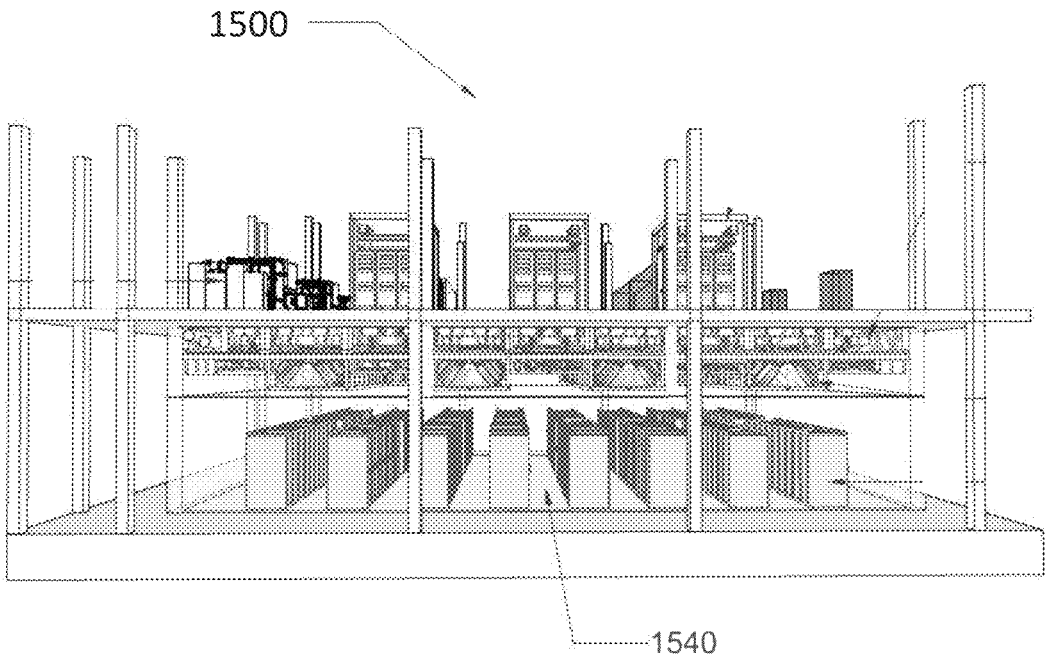
FIG. 10 is a perspective view of a structure housing ISMs and an application environment, in accordance with some embodiments.
Figure 11:
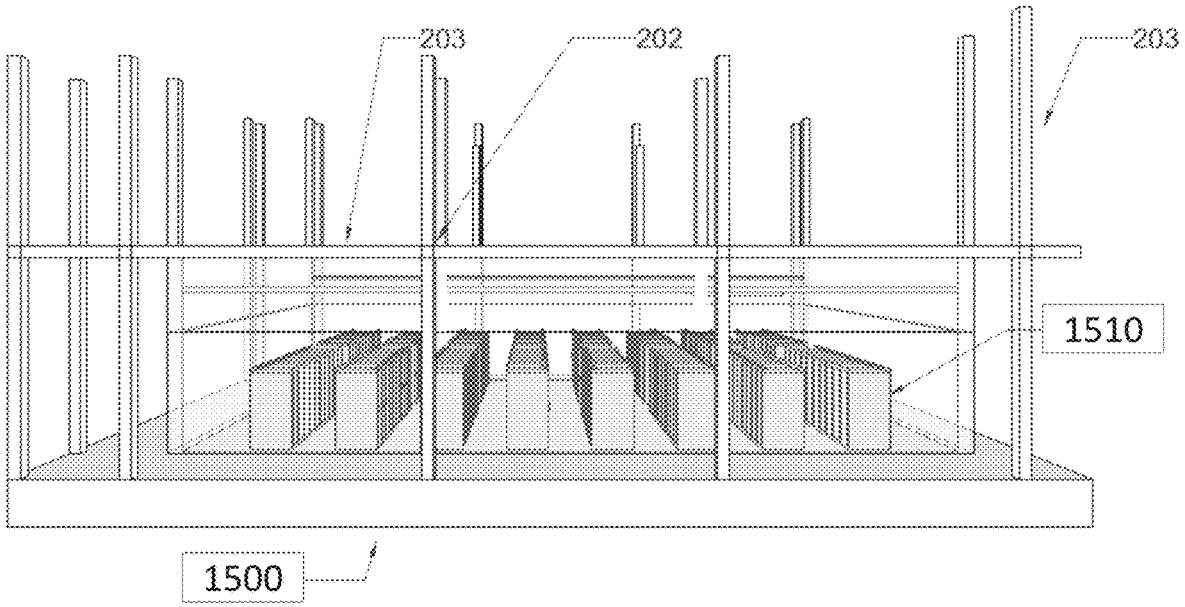
FIG. 11 is a cross-sectional view of a structure housing ISMs and an application environment, in accordance with some embodiments.

FIG. 9B shows a cross-sectional view of a facility 1500 housing a data center 1510 on first level and one or more ISMs 1520 on a second level. In some embodiments, the one or more ISMs are configured to be assembled to form a sub-assembly of ISMs. In some embodiments, a full assembly of ISMs may be made up of two sub-assemblies 1520*a* and 1520*b*. In some embodiments, a full assembly of ISMs may be made up of 2 or more sub-assemblies of ISMs. In some embodiments, the sub-assembly of ISMs is configured to be assembled to an existing assembly of ISMs to form larger assemblies of ISMs, so as to extend/expand a performance, functionality, capacity and/or capability of the one or more application environments. As an example, looking to FIG. 9B, the facility may start out with a first sub-assembly of ISMs 1520*a* with an application environments directly below the first sub-assembly. For example, the application environment may be a data center. In some embodiments, the data center may be expanded into open space to increase the size of the data center, and a second sub-assembly of ISMs 1520*b* can be installed directed above the expanded area of the data center to accommodate for the increased cooling, power supply, etc., demands of the expanded and newly enlarged data center.

In some embodiments, the sub-assembly of ISMs is configured to be assembled to the existing assembly of ISMs in two or more dimensions. In some embodiments, the two or more dimensions lie on a same plane. In some embodiments, the two or more dimensions lie on different planes. In some embodiments, the two or more dimensions may comprise at least one direction that is horizontal/lateral and at least one other direction that is vertical. For example, an additional level of ISMs may be installed on top of or below an existing level of ISMs to accommodate for an increase in size to the application environment. In addition, a sub-assembly of ISMs may be added horizontally, as described in the FIG. 9B scenario above, to an existing sub-assembly of ISMs. In some embodiments, a sub-assembly of ISMs may be installed on top of or below and horizontally to an existing sub-assembly of ISMs.

In some embodiments, the one or more ISMs are configured to be assembled in series or in parallel, in two or more dimensions, to expand/increase/extend a performance, functionality, capacity, and/or capability of the one or more application environments. In some embodiments, the one or more ISMs are configured to be assembled in a manner that allows for a capacity of the one or more application environments to increase as required, without having to modify or retrofit the one or more application environments for expansion. For example, the application environment may comprise a data center. In this fashion, a capacity of the data center can increase without the need for an expansion of the facility that houses the data center.

Looking back to FIG. 9B, the facility 1500 may comprise one or more columns 1530 that can be configured to support the vertical load of the one or more ISMs. In some embodiments, the one or more ISMs rest on one or more beams. In some embodiments, the one or more beams are configured to attach and/or couple to the one or more columns 1530 in a manner such that the vertical component of the one or more ISMs is supported. In some embodiments, these columns 1530 can be adjustable such that a height of the one or more ISMs above the application environment may be adjusted. For example, the columns may be adjusted to lower the existing ISMs to accommodate for an additional level of ISMs above the existing level. As an additional example, the columns may be adjusted to raise the level of ISMs higher above the application environment. This may be done to accommodate for a new height of a new application environment, or accommodate a new height as a result of a modification/expansion of an existing application environment.

In some embodiments, the one or more ISMs include one or more vertical load-bearing structures. In some embodiments, the one or more vertical load-bearing structures are configured to enable the ISMs to be continuously stacked in a vertical direction. In some embodiments, a level of ISMs may include the necessary mechanical, plumbing, network, etc., connections required to accommodate a new level of ISMs above or below the existing level of ISMs.

Looking to FIGS. 9A-9B, 10, and 11, the application environment may include one or more corridors 1540. In some embodiments, the one or more ISMs are configured to be integrated with or connected to one or more corridors in the one or more application environments. As shown in FIG. 9B, the sub-assemblies 1520*a* and 1520*b* are assembled directly above the application environment 1510, and comprise corresponding open areas above the corridors 1540. In this way, the one or more ISMs are integrated with the corridors of the application environment. As shown in FIG. 9B, the one or more corridors 1540 may extend along an edge or a center portion of the one or more application environments.

In some embodiments, the one or more corridors are configured to serve as an interface for coupling with one or more additional ISMs. In some embodiments, the one or more corridors are configured to serve as an interface/area for coupling the one or more ISMs to external systems and/or structures. As an example, external systems may include third party equipment specific to the application environment, such as air filters or ventilation systems configured to control particle concentration in specific areas of the application environment. As an example, external structures may include structural components of the building 202 and 203 configured to support the one or more ISMs.

In some embodiments, the one or more corridors may be above, below, or to the side of the one or more ISMs. In some embodiments, the one or more corridors are configured to divide and/or control operator or user access to the one or more ISMs. In some embodiments, the one or more corridors are configured to contain or enclose a subset of ISMs. For example, a subset of ISMs may include important equipment to the application environment that is fragile, expensive, or is otherwise desirable to be blocked off from general human access. The one or more corridors may be configured to block of such a subset of ISMs. In addition, in some embodiments, the one or more corridors are configured to create specialized environment enclosing the subset of the ISMs and a portion of the application environment beneath the subset of ISMs. This may be used, in addition to the ability to seal off one or more functional components of the ISMs (e.g., as described above), to provide a sterile environment for an important step in a manufacturing process (e.g., such as a step in the semiconductor manufacturing process).

Figure 13A:
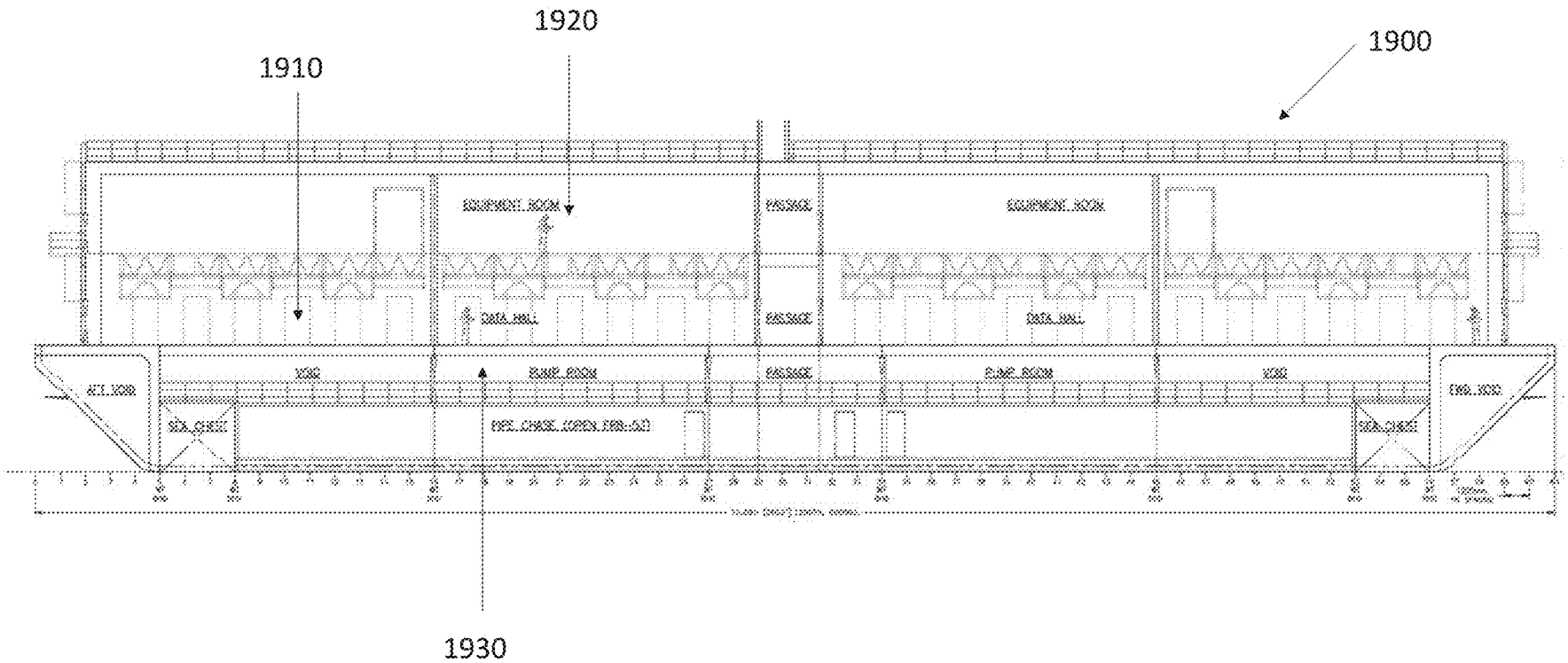
FIGS. 13A-13C illustrate a structure housing of ISMs and an application environment, in accordance with some embodiments.
Figure 13B:
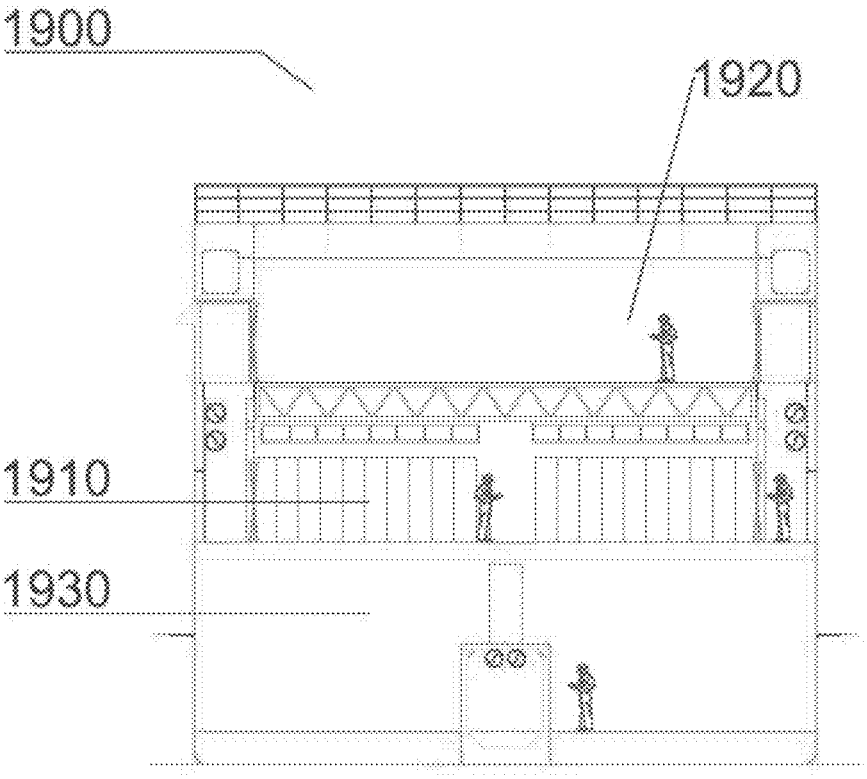
Figure 13C:
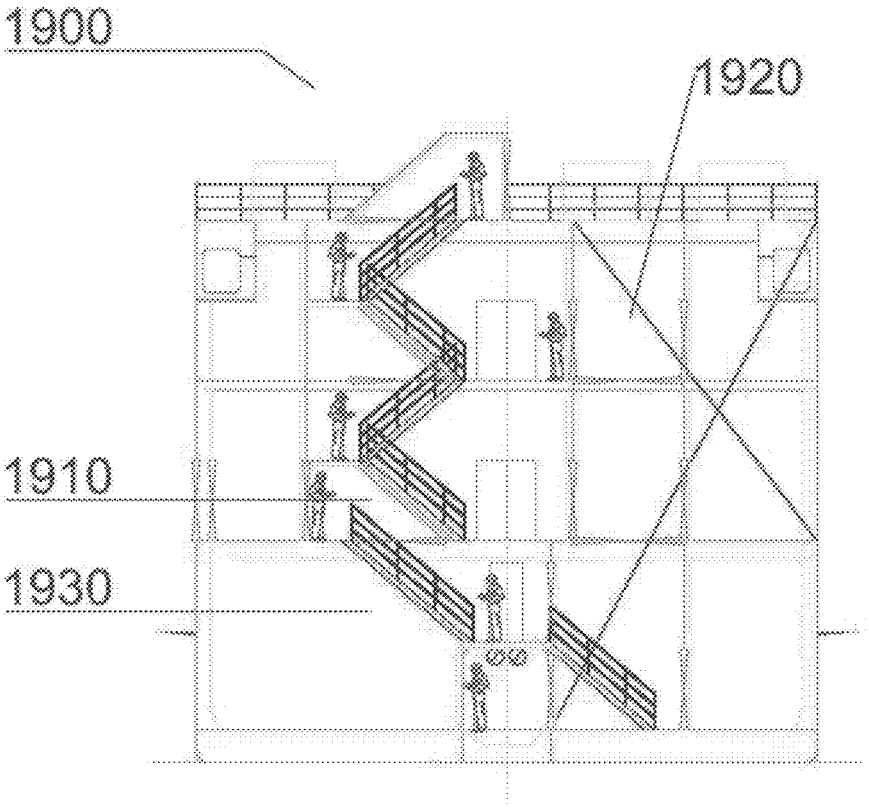

FIGS. 13A-13C illustrate an example ISM system 1920 integrated with one or more application environments 1910, which may be constructed on a barge or vessel 1900. There may be a staircase in the middle of the barge allowing a human operator 1930 or user to travel between the levels (e.g., ISM level, application environment level). The one or more ISMs may be as any other ISMs described herein, and may provide or restrict access to human operators or users on the ISM level. Implementing one or more application environments with one or more ISMs on a barge allows for sourcing cooling water from a body of water.

In some embodiments, the architecture of any one of the embodiments described herein is implemented using at least in part one or more modular assembly kits comprising of the one or more ISMs. In some embodiments, the kits may be suitable for any type of ISM described herein and for any type of application environment described herein. In some embodiments, there may be different kits configured to be suitable for different application environments. For example, the application environment may be a data center and the kit may comprise the one or more ISMs necessary for running the data center. As an additional example, the application environment may be a manufacturing facility and the kit may comprise the ISMs necessary for manufacturing the desired product in the manufacturing facility. In some embodiments, the kits may be used in any building/facility/structure described herein that contains the one or more application environments. In some embodiments, the kits may be shipped/transported using the methods as described herein for the one or more ISMs. In some embodiments, the kits are configured to facilitate the rapid assembly of the one or more ISMs as described herein. In some embodiments, the kits may be used for new installation of one or more ISMs in one or more application environments. In some embodiments, the kits may be for interchanging/replacing/swapping one or more ISMs in an existing assembly of ISMs in one or more application environments. In some embodiments, the kits may comprise one or more ISMs for configuring an initial ISM assembly in one or more application environments. In some embodiments, the kits may comprise one or more ISMs for reconfiguring an existing ISM assembly for use in either the same one or more application environments, or different one or more application environments. In some embodiments, the kits may include one or more ISMs for expanding the capacity of an initial ISM assembly for use in either the same one or more application environments, or different one or more application environments.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein can be employed in practicing the invention. It is intended that the following claims define the scope of the invention and that methods and structures within the scope of these claims and their equivalents be covered thereby.

What is claimed is:

1. A modular design and build architecture, comprising:

one or more integrated system module (ISMs) that are configured to be shipped and coupled with one or more structural components within a facility to construct an operational infrastructure for one or more data halls housed in the facility, wherein each of the ISMs comprises: (i) at least a first functional component mounted on a top surface of a platform base, and (ii) one or more additional functional components comprising a ceiling package or a mechanical, electrical, and plumbing (MEP) package located beneath or within the platform base, wherein the one or more ISMs form a level above the one or more data halls, and wherein the one or more additional functional components vertically connects the one or more ISMs to the one or more data halls.

2. The architecture of claim 1, wherein individual ISMs on the level are removable or replaceable.

3. The architecture of claim 1, wherein the level is configured to separate or divide a volume or space within the one or more data halls.

4. The architecture of claim 1, wherein the level comprises a porous layer that is permeable to air, gas or a fluid.

5. The architecture of claim 1, wherein the level comprises a barrier layer that is impermeable to air, gas or a fluid.

6. The architecture of claim 1, wherein the level comprises or forms an interstitial space.

7. The architecture of claim 1, wherein the first functional component and the one or more additional functional components are associated with at least one or more of the following: electrical, power, mechanical, plumbing, cooling, heating, network connectivity, data transmission, sensors or sensing, fire suppression, or chemical or biological material management.

8. The architecture of claim 1, wherein the one or more ISMs are provided having a standardized size or format to facilitate ease of transport such that the ISMs are capable of being shipped using conventional transportation modes and reducing a total number of shipments required to ship equipment for construction of the operational infrastructure, and without requiring size, weight or height modifications or customization of transportation containers or vehicles, wherein the conventional transportation modes comprise land, sea, rail or air transportation modes.

9. The architecture of claim 1, wherein the platform base enables (i) interchangeability of functional components or their physical order/arrangement within an ISM, or (ii) interchangeability, coupling or changes in arrangement order between different ISMs.

10. The architecture of claim 1, wherein the one or more ISMs are configured to facilitate rapid assembly using fewer number of mechanical and/or electrical connections/connectors and less time, compared to other data halls that are not constructed using said ISMs.

11. The architecture of claim 1, wherein the one or more additional functional components comprises a ceiling package and a MEP package, and the ceiling package is located below or in proximity to the MEP package.

12. The architecture of claim 11, wherein the ceiling package is located closer to the one or more data halls than the MEP package or the first functional component.

13. The architecture of claim 1, wherein the MEP package comprises the mechanical, electrical, and plumbing equipment necessary for running and maintaining the facility housing the one or more data halls.

14. The architecture of claim 1, wherein the one or more structural components comprise a post, a beam, a column, or a combination thereof, within the facility.

15. A method of modularly constructing an operational infrastructure, the method comprising:

a) providing one or more integrated system modules (ISMs), wherein each of the ISMs comprises: (i) at least a first functional component mounted on a top surface of a platform base, and (ii) one or more additional functional components comprising a ceiling package or a mechanical, electrical, and plumbing (MEP) package located beneath or within the platform base;

b) coupling the one or more ISMs with one or more structural components within a facility to construct the operational infrastructure for one or more data halls housed in the facility, wherein the one or more ISMs form a level above the one or more data halls; and c) using the one or more additional functional components to vertically connect the one or more ISMs to the one or more data halls.

16. The method of claim 15, further comprising: removing or replacing individual ISMs from the level.

17. The method of claim 15, further comprising: using the level to separate or divide a volume or space within the one or more data halls.

18. The method of claim 15, wherein the level comprises a porous layer that is permeable to air, gas or a fluid.

19. The method of claim 15, wherein the level comprises a barrier layer that is impermeable to air, gas or a fluid.

20. The method of claim 15, wherein the level comprises or forms an interstitial space.

21. The method of claim 15, wherein the first functional component and the one or more additional functional components are associated with at least one or more of the following: electrical, power, mechanical, plumbing, cooling, heating, network connectivity, data transmission, sensors or sensing, fire suppression, or chemical or biological material management.

22. The method of claim 15, wherein the one or more ISMs are provided having a standardized size/format to facilitate ease of transport such that the ISMs are capable of being shipped using conventional transportation modes and reducing a total number of shipments required to ship equipment for construction of the operational infrastructure, and without requiring size, weight or height modifications or customization of transportation containers or vehicles, wherein the conventional transportation modes comprise land, sea, rail or air transportation modes.

23. The method of claim 15, wherein the platform base enables (i) interchangeability of functional components or their physical order/arrangement within an ISM, or (ii) interchangeability, coupling or changes in arrangement order between different ISMs.

24. The method of claim 15, wherein the one or more ISMs are configured to facilitate rapid assembly using fewer number of mechanical and/or electrical connections/connectors and less time, compared to other data halls that are not constructed using said ISMs.

* * * * *